US007367868B2

(12) United States Patent
Memmelaar, Sr. et al.

(10) Patent No.: US 7,367,868 B2
(45) Date of Patent: May 6, 2008

(54) CENTERLESS GRINDER

(75) Inventors: John Memmelaar, Sr., Franklin Lakes, NJ (US); Kevin Jobes, Highland Lakes, NJ (US); Todd Morris, New Windsor, NY (US)

(73) Assignee: Royal Master Grinders, Inc., Oakland, NJ (US)

( * ) Notice: Subject to any disclaimer, the term of this patent is extended or adjusted under 35 U.S.C. 154(b) by 0 days.

(21) Appl. No.: 11/586,143

(22) Filed: Oct. 25, 2006

(65) Prior Publication Data

US 2007/0037489 A1 Feb. 15, 2007

Related U.S. Application Data

(62) Division of application No. 10/750,803, filed on Jan. 2, 2004, now Pat. No. 7,147,542.

(51) Int. Cl.
*B24B 49/00* (2006.01)
*B24B 51/00* (2006.01)

(52) U.S. Cl. ..... 451/11; 451/49; 451/243; 451/909

(58) Field of Classification Search ..... 451/11, 451/49, 69, 182, 243, 407, 408, 909
See application file for complete search history.

(56) References Cited

U.S. PATENT DOCUMENTS 1,393,046 A 10/1921 Singer
1,575,520 A 3/1926 Archea
1,688,103 A 10/1928 Archea
1,723,128 A 8/1929 Binns
2,335,196 A * 11/1943 Pecsok ..... 29/81.03
2,391,499 A * 12/1945 Yoder ..... 72/40
2,581,226 A 1/1952 Arnold
2,886,926 A 5/1959 McCrosky
3,065,582 A 11/1962 James (Continued)

FOREIGN PATENT DOCUMENTS

JP 60-177851 9/1985

OTHER PUBLICATIONS

"TF-9DHD Auto Infeed & Thrufeed Centerless Grinder," Glebar Company Inc., no date available

*Primary Examiner*—Maurina Rachuba
(74) *Attorney, Agent, or Firm*—Lerner, David, Littenberg, Krumholz & Mentlik, LLP

(57) ABSTRACT

A centerless grinder for grinding an elongated workpiece includes a grinding wheel having a working surface with a plurality of raised areas extending circumferentially around at least a portion of the working surface. A platform is provided having an elongated top surface for supporting the workpiece substantially adjacent to the working surface of the grinding wheel and a front surface with a plurality of lateral grooves for receiving the raised areas on the working surface of the grinding wheel such that movement of the platform toward the working surface into a working area adjacent to the grinding wheel enables the raised areas to pass into the lateral grooves and grind the workpiece. The centerless grinder further includes a first spindle and collet in front of the working area and a second spindle and collet behind the working area, for grinding both ends of an elongated workpiece without removing the workpiece from the grinder, and a wire spool assembly for grinding wire stock directly from the wire spool.

5 Claims, 18 Drawing Sheets

U.S. PATENT DOCUMENTS

| | | | | |
|---|---|---|---|---|
| 3,123,949 | A | | 3/1964 | Ross |
| 3,323,258 | A | | 6/1967 | Terp et al. |
| 3,479,773 | A | | 11/1969 | Mills |
| 3,534,507 | A | | 10/1970 | Barhorst |
| 4,018,011 | A | | 4/1977 | Whittenberg |
| 4,069,623 | A | | 1/1978 | Maxey |
| 4,086,065 | A | | 4/1978 | Maxey |
| 4,271,639 | A | | 6/1981 | Talalay et al. |
| 4,783,932 | A | | 11/1988 | Sager |
| 4,976,572 | A | * | 12/1990 | Habegger ..... 409/132 |
| 5,480,342 | A | | 1/1996 | Bannayan et al. |
| 5,674,106 | A | | 10/1997 | Cheetham |
| 5,746,644 | A | * | 5/1998 | Cheetham ..... 451/6 |
| 6,123,605 | A | | 9/2000 | Yano |
| 6,176,766 | B1 | | 1/2001 | Silverman |
| 6,193,591 | B1 | | 2/2001 | Stahl et al. |
| 6,852,006 | B1 | | 2/2005 | Gleason et al. |
| 6,991,518 | B1 | | 1/2006 | Gleason et al. |

* cited by examiner

CENTERLESS GRINDER

CROSS REFERENCE TO RELATED APPLICATIONS

The present application is a divisional application which claims the benefit of U.S. patent application Ser. No. 10/750,803, filed on Jan. 2, 2004 now U.S. Pat. No. 7,147,542, the disclosure of which is hereby incorporated by reference herein.

BACKGROUND OF THE INVENTION

The present invention relates to centerless grinders.

Centerless grinders are well known machines for grinding elongated cylindrical workpieces such as medical guide wires, rods, pins, golf club shafts, antenna, fishing rods and similar articles. Conventional centerless grinders include a supporting structure on which a grinding wheel and a regulating wheel are mounted with their working surfaces facing each other and slightly separated. The workpiece is positioned between these two wheels ("the working area"). These wheels rotate in the same direction about a substantially horizontal axis at different speeds. The axis of rotation of the regulating wheel is somewhat inclined from the horizontal plane, however, to provide a "tilt angle." This tilt angle causes the workpiece to move forwardly through the working area as the workpiece is being ground to a particular profile by the grinding wheel. The profile is controlled by moving the regulating wheel toward or away from the grinding wheel as the workpiece passes through the working area.

The grinding wheel typically is approximately 12 inches in diameter and spins at approximately 2500 rpm, and the regulating wheel typically is approximately 6 inches in diameter and spins at approximately 50 rpm. The width of the working surfaces of both the grinding wheel and the regulating wheel typically is approximately 1.5 inches and can range from between 0.25 inches and 4.0 inches. Different surfaces are provided on the grinding wheel and the regulating wheel to provide greater friction between the regulating wheel and the workpiece than that between the grinding wheel and the workpiece. The regulating wheel also may have a plurality of grooves extending circumferentially around its working surface. As a result, the speed and direction of rotation of the workpiece is controlled by the speed and direction of rotation of the regulating wheel, and the grinding wheel moves in a direction of rotation opposite to that of the workpiece to grind the workpiece.

As shown in FIG. 1, in conventional centerless grinders, a work rest blade 109 is positioned in the working area 107 between the grinding wheel 101 and the regulating wheel 103 for supporting the workpiece 105 during the grinding process. The work rest blade may be attached to a holder (not shown) whose surface facing the regulating wheel may be grooved to cooperate with the grooves on the regulating wheel's working surface. A typical work rest blade is extremely thin and has a supporting surface that slopes upwardly at about a 30° angle in the direction from the regulating wheel to the grinding wheel. Highly abrasive particles ground from the workpiece typically collect on this surface. Since the workpiece is rotating in relation to the work rest blade (which is stationary), the workpiece and these particles tend to grind the work rest blade during the grinding process. As a result, the work rest blade must be replaced frequently during typical manufacturing operations resulting in delays in the manufacturing process. Also, for a similar group of workpieces, the work rest blade typically is ground to a specific profile to accommodate the dimensions of the workpiece. Grinding each new work rest blade to such a specific profile further delays the manufacturing process.

Since the work rest blade is positioned between the grinding wheel and the regulating wheel and both of these wheels must simultaneously engage the workpiece, the extent to which the workpiece can be ground is limited by the width of the work rest blade. If the work rest blade is made too narrow, moreover, it will break during the grinding process. In addition, if the work rest blade is ground to a narrow profile to accommodate thin workpieces such as medical guide wires, the extent to which the regulating wheel can be backed away from the grinding wheel also is limited. If the regulating wheel is moved too far away from the grinding wheel, moreover, the workpiece will slip off of the work rest blade resulting in damage to the workpiece and possible damage to the grinding/regulating wheel assembly.

Since the workpiece's forward movement between the grinding wheel and the regulating wheel is controlled by the regulating wheel's speed and tilt angle (among other factors), slight changes in either of these factors can result in errors in the workpiece's desired grinding profile. In order to prevent such errors, systems employing optical sensors, such as those disclosed in U.S. Pat. No. 5,480,342, assigned to Royal Master Grinders, Inc., the assignee of the present application, are used to precisely detect the workpiece's position and to move the regulating wheel in response to this detected position.

A centerless grinder has been produced that operates without a regulating wheel or a work rest blade. In place of the regulating wheel, a spindle having a collet for securing a workpiece 211 (FIGS. 2 and 3) is positioned in front of the working area. Workpiece 211 is passed through the spindle (not shown), and the collet then is tightened around the workpiece. The workpiece then is passed into the working area as a motor rotates the spindle at a particular speed and direction to control the workpiece's speed and direction of rotation adjacent the grinding wheel. As shown in FIGS. 2 and 3, workpiece 211 passes through an elongated bushing 203 in the working area that holds workpiece 211 adjacent the grinding wheel (not shown). Elongated bushing 203 is within a bushing blade 205, and a bushing blade holder 201 supports bushing blade 205. Passageways 207 within bushing blade 203 and bushing blade holder 201 provide coolant to the grinding wheel and workpiece. A slot 209 within bushing blade 205 and elongated bushing 203 enables the grinding wheel to contact workpiece 211. Elongated bushing 203 has an inner diameter slightly greater than the diameter of workpiece 211. Slot 209 is between approximately 0.020 and 0.030 inches in width. To control the workpiece's grinding profile, a first servomotor moves the spindle/collet toward and away from the working area, and a second servomotor moves the elongated bushing toward and away from the grinding wheel.

The grinding wheel for this centerless grinder must be extremely thin to fit into slot 209 in order to contact workpiece 211. The grinding wheel typically is between approximately 1/16 and 1/8 inches in width, and is chamfered at its working surface to fit into this slot. This width is substantially thinner than that of a conventional centerless grinder having a regulating wheel (which, as discussed above, typically is approximately 1.5 inches in width). Because of this thin width, the grinding wheel is fragile and prone to breaking. Also, the grinding process is extremely slow, and the workpiece must be moved through the working area at a rate substantially slower than that for conventional centerless grinders. As a result, the range of useful functions for this centerless grinder is severely limited.

Elongated workpieces typically are fabricated from wire stock shipped on spools. Before the grinding process can begin for a particular set of workpieces, the wire must be dispensed by hand from this spool and cut into a plurality of equal lengths. Each length of wire then must be placed into a feeder for transmitting the wire through the working area. These steps substantially delay the manufacturing process.

Some elongated workpieces require a grinding profile at both ends. After placing the work piece onto the feeder and transmitting the workpiece through the working area, therefore, the workpiece must be removed from the grinder and again placed back on the feeder with its opposite end facing the working area for a second pass through this area. These steps also substantially delay the manufacturing process.

SUMMARY OF THE INVENTION

The present invention provides a centerless grinder without a regulating wheel or a work rest blade and the attendant problems with those elements discussed above. The centerless grinder of the present invention also overcomes the problems of previous centerless grinders, such as those discussed above in connection with FIGS. 2 and 3, that have attempted to eliminate the regulating wheel and work rest blade. The present invention also provides a centerless grinder with a system for grinding both ends of an elongated workpiece without removing the workpiece from the grinder and for grinding workpieces directly from a wire spool.

In one embodiment, the present invention provides a centerless grinder without a regulating wheel. The centerless grinder of this first embodiment includes a grinding wheel having a working surface with a plurality of raised areas extending circumferentially around at least a portion of the working surface. The centerless grinder also includes a platform having an elongated top surface for supporting a workpiece substantially adjacent to the working surface. The platform has a front surface with a plurality of lateral grooves for receiving the raised areas on the working surface such that movement of the platform toward the working surface into a working area adjacent the grinding wheel enables the raised areas to pass into the lateral grooves and grind the workpiece.

The platform preferably includes an elongated groove forming a shelf along the intersection of the front surface and the top surface, and the workpiece is supported within this elongated groove. The elongated groove preferably is generally L-shaped. The lateral grooves on the platform's front surface preferably are substantially parallel to each other, are spaced substantially equally distant from one another and extend from the bottom of the elongated groove down the front surface. The depth of the lateral grooves along the bottom of the elongated groove preferably tapers from a greater depth at one end of the elongated groove to a lesser depth at the other end of the elongated groove. In a preferred embodiment, the height of the raised areas on the grinder's working surface correspondingly tapers from a greater height at the one end of the elongated groove to a lesser height at the other end of the elongated groove. As a result, the distance between the raised areas and the back of the elongated groove, when the raised areas are within the lateral grooves, tapers from a lesser distance at the one end to a greater distance at the other end. The workpiece, therefore, is progressively ground to a selected diameter as it travels from the other end to the one end. In addition, the bottom of the elongated groove preferably slopes upwardly at a slight angle in the direction of the grinding wheel to urge the workpiece toward the corner of the elongated groove.

In a second embodiment, the present invention provides a centerless grinder for grinding workpieces directly from a wire spool. The centerless grinder of this second embodiment includes a grinding wheel and a support for holding a workpiece and for moving the workpiece laterally toward the grinding wheel into a working area adjacent the grinding wheel for grinding the workpiece. The centerless grinder further includes a spindle and collet positioned in front of the working area for rotating the workpiece and for moving the workpiece one or both of forwardly and backwardly through the working area. In addition, the centerless grinder includes a spool for holding wire stock, and a gripper for pulling a length of the wire stock from the spool and transmitting the length of wire stock from the spool through the spindle and collet. A cutter is provided for cutting the length of wire stock to provide the workpiece. The gripper preferably comprises pinch rollers or an indexing gripper.

In a third embodiment, the present invention provides a centerless grinder for grinding both ends of an elongated workpiece. The centerless grinder of this third embodiment includes a grinding wheel and a support for holding the workpiece and moving the workpiece laterally toward the grinding wheel into a working area adjacent the grinding wheel for grinding the workpiece. The centerless grinder further includes a first spindle and collet positioned in front of the working area for rotating the workpiece and moving the workpiece one or both of forwardly and backwardly through the working area. The centerless grinder also includes a second spindle and collet positioned behind the working area for rotating the workpiece and moving the workpiece one or both of forwardly and backwardly through the working area.

The centerless grinder preferably includes a first pivot and a second pivot. The first spindle and collet preferably is coupled to the support through the first pivot to maintain alignment of the first spindle and collet with the support during movement of the workpiece laterally toward the grinding wheel. The second spindle and collet preferably is coupled to the support through the second pivot to also maintain alignment of the second spindle and collet with the support during movement of the workpiece laterally toward the grinding wheel.

The grinding wheel preferably has a working surface with a plurality of raised areas extending circumferentially around at least a portion of the working surface, and the support preferably comprises a platform having an elongated top surface for supporting the workpiece substantially adjacent to the working surface and a front surface with a plurality of lateral grooves for receiving the raised areas on the working surface such that movement of the platform toward the working surface enables the raised areas to pass into the lateral grooves and grind the workpiece. In the alternative, the support may comprise an elongated bushing having a slot for receiving the grinding wheel.

The present invention also provides methods of grinding an elongated workpiece using a centerless grinder. In one embodiment, the centerless grinder includes a grinding wheel, a support for holding the workpiece and moving the workpiece laterally toward the grinding wheel into a working area adjacent the grinding wheel for grinding the workpiece, a spindle and collet positioned in front of the working area for rotating the workpiece and moving the workpiece one or both of forwardly and backwardly through the working area, a spool for holding wire stock and a guide. The method includes moving the spindle and collet backwardly away from the working area, and dispensing a length of the wire stock from the spool into the guide and from the guide through the spindle and collet. The method further includes closing the collet to grip the wire stock, and cutting the wire stock to provide the workpiece. In addition, the method includes moving the spindle and collet one or both of toward the working area and away from the working area, while rotating the spindle and collet, to grind the workpiece.

The centerless grinder preferably includes pinch rollers for pulling the wire stock from the spool, and the dispensing preferably includes rotating the pinch rollers to dispense the length of wire stock. The method preferably also includes, before cutting the wire stock to provide the workpiece, opening the pinch rollers and moving the spindle and collet forwardly to dispense a further length of the wire stock. In addition, the method preferably includes, before cutting the wire stock to provide the workpiece, closing the pinch rollers.

In another method, the centerless grinder includes a grinding wheel, a support for holding the workpiece and moving the workpiece laterally toward the grinding wheel into a working area adjacent the grinding wheel for grinding the workpiece, a first spindle and collet positioned in front of the working area for rotating the workpiece and moving the workpiece one or both of forwardly and backwardly through the working area, and a second spindle and collet positioned behind the working area for rotating the workpiece and moving the workpiece one or both of forwardly and backwardly through the working area. The method includes grinding one end of the workpiece using the first spindle and collet, and moving one or both of the first spindle and collet and the second spindle and collet such that the one end of the workpiece passes into the second spindle and collet. The method further includes opening the first collet to release the workpiece, closing the second collet to grip the workpiece, and removing the workpiece from the working area using the second spindle and collet. The method preferably also includes grinding the other end of the workpiece using the second spindle and collet.

DETAILED DESCRIPTION OF THE PREFERRED EMBODIMENTS

Figure 1:
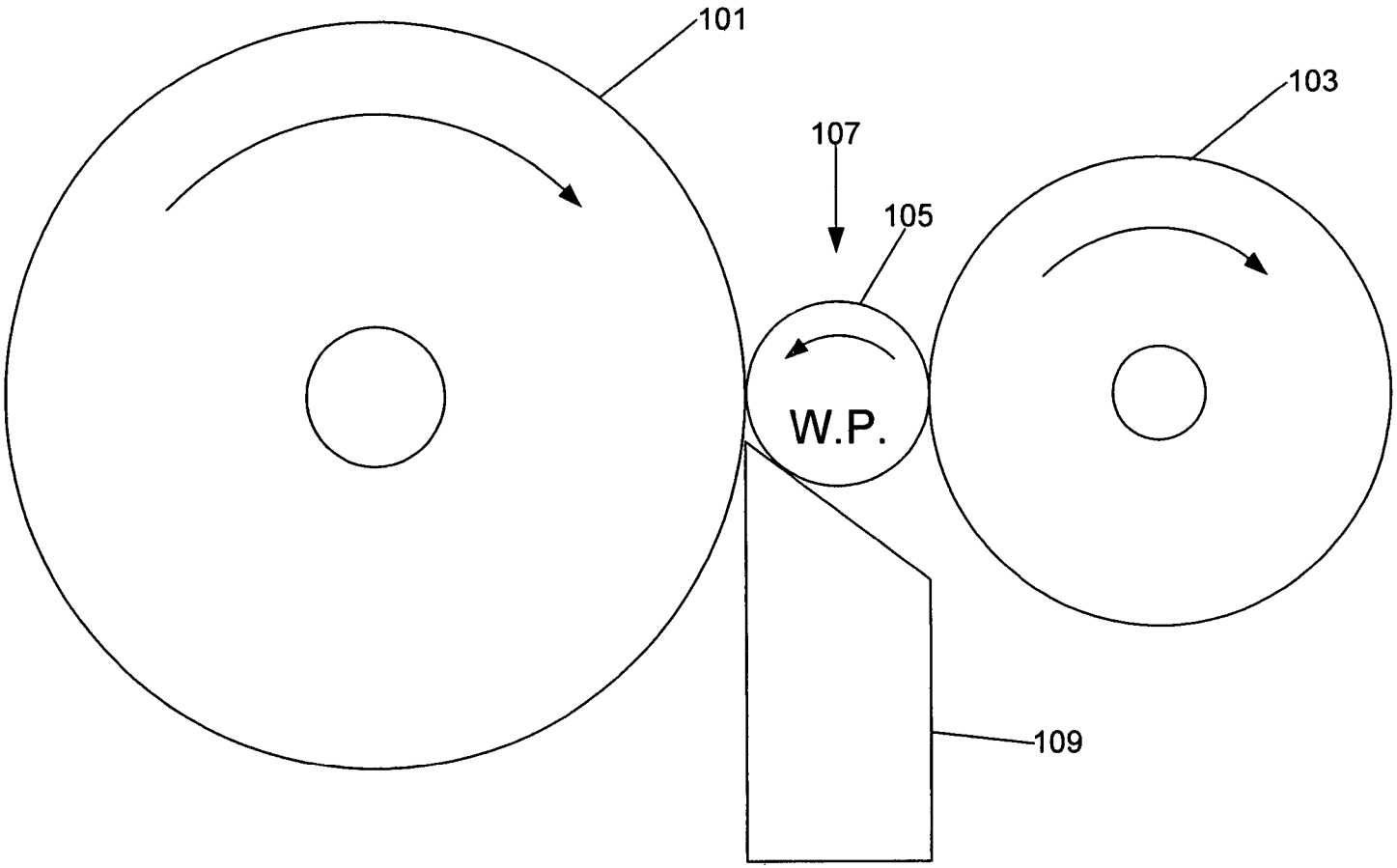
FIG. 1 (PRIOR ART)
FIG. 1 is a side view of a grinding wheel, regulating wheel, work rest blade and workpiece of a conventional centerless grinder.

Perspective, front elevational, top plan, right side elevational and left side elevational views of a centerless grinder 400 in accordance with the present invention are shown and FIGS. 4, 5, 6A, 6B and 6C, respectively. Centerless grinder 400 can be used for grinding, for example, medical guide wires, rods, golf club shafts, antenna, fishing rods and a variety of small (an inch or less) metallic and nonmetallic parts. Centerless grinder 400 also can be used for grinding parts in accordance with severe or unusual grinding profiles (for example, a twisted helix) and parts made of materials that are hard to grind (for example, nickel titanium).

Centerless grinder 400 includes a grinding wheel (also called a work wheel) 425 which rotates on a shaft (not shown). Grinding wheel 425 is driven by a belt and is powered by an electric motor (not shown) enclosed within a housing 435. Housing 435 also encloses electronic controls and other electronics for centerless grinder 400. Housing 609 (FIG. 6C) encloses the grinding wheel belt. Additional electronics for centerless grinder 400 are enclosed within housing 459.

A dresser assembly 455 is located above grinding wheel 425. Dresser assembly 455 includes a diamond tip (not shown) and various controls for positioning the diamond tip on the working surface of the grinding wheel for dressing this surface. Wheel guard 431 and housing 607 (FIG. 6C) provide a protective enclosure for grinding wheel 425. A coolant tank 437 provides coolant to the grinding area adjacent grinding wheel 425 ("the working area") through coolant pipe 605.

Platform 423 (shown in detail in FIGS. 7-13) supports a workpiece in the working area. Holder 421, in conjunction with other holders discussed below (also shown in detail in FIGS. 7-13), supports platform 423 in the working area. The grinding wheel's working surface 701 has a plurality of raised areas 703, shown in detail in FIGS. 7 and 11, that cooperate with platform 423 in grinding a workpiece 705.

Platform 423 is attached to ram assembly 433. Ram assembly 433 moves on a cross rollerway slide (not shown) laterally toward and away from grinding wheel 425. This lateral movement, in combination with forward and backward movement of the workpiece through the working area, grinds the workpiece in accordance with a predetermined grinding profile programmed into computer system 457. The cross rollerway slide comprises two platforms with bearings between them to enable movement of the upper platform. Ram assembly 433 is attached to the upper platform, and housing 435 supports the lower platform. An optical encoder head (not shown) detects the position of the upper platform in relation to the lower platform using a linear glass scale and provides in response electrical signals to computer system 457. The linear glass scale includes etched glass strips on the platforms that provide differences in reflection and diffraction patterns. Based upon the electrical signals provided to computer system 457, the computer system continuously calculates and determines the position of platform 423 during the grinding process. A servomotor rotates a feed screw 603 connected to yoke 441, on a nut 439, to cause the ram assembly's lateral movement.

Computer system 457 is integrated into a portion of swing arm 449 and includes a touch-sensitive computer screen 447, attached to the end of this swing arm, for use by an operator in controlling and programming the computer system. Computer system 457 includes a digital processor, one or more random access memories (RAMs) for storing instructions and data, one or more read-only memories ROMs for storing programs, and other components conventionally found in a personal computer or digital computer system.

Figure 16:
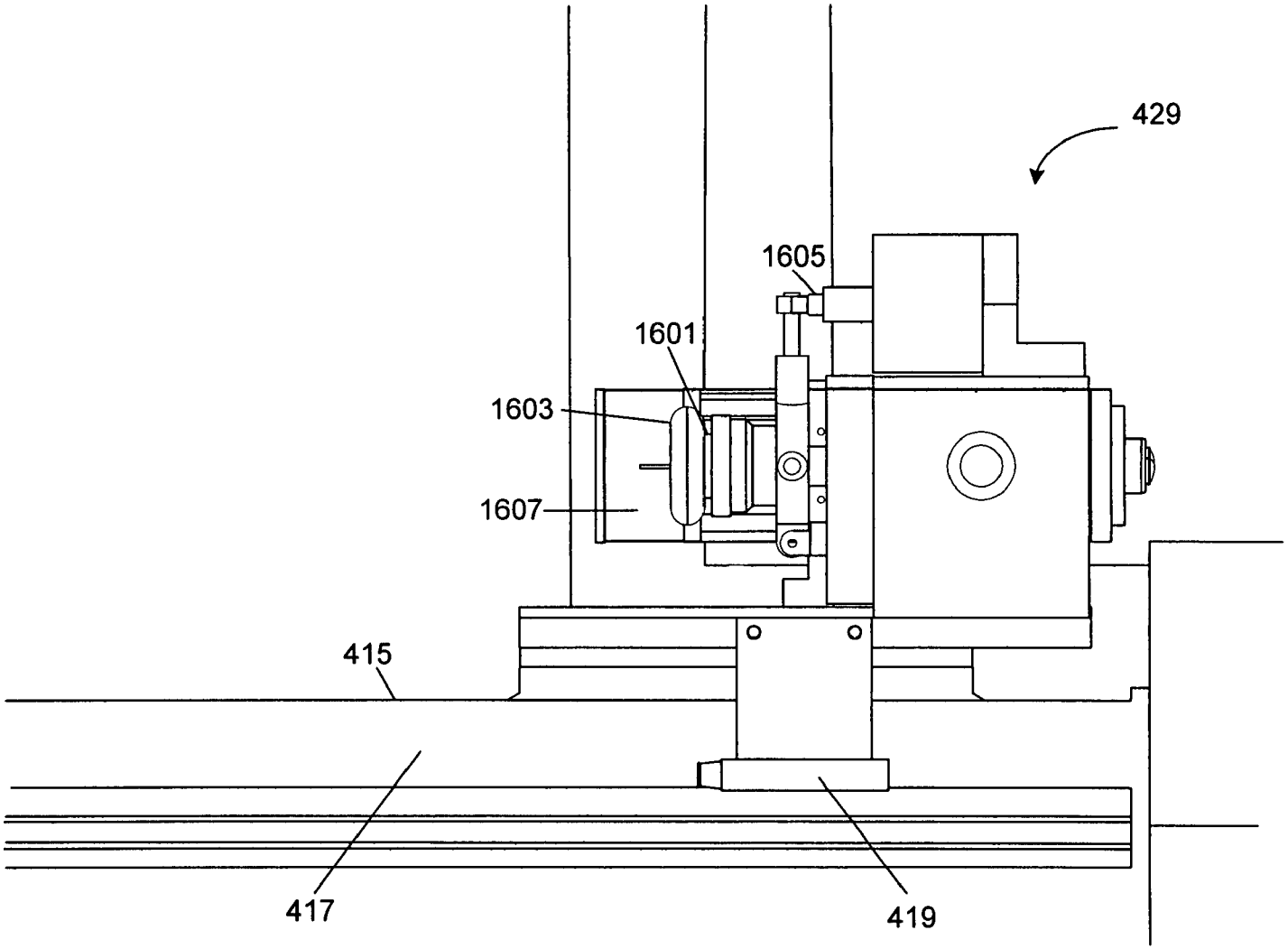
FIG. 16 is a front elevational view of the front spindle assembly of the centerless grinder of FIGS. 4-6C.

A spindle assembly 429 is attached to a linear actuator 463 positioned in front of the working area. Spindle assembly 429, shown in greater detail in FIG. 16, includes a spindle 1601 and a collet 1603. A passageway (not shown) aligned with the axis of spindle 1601 enables a workpiece to be inserted through spindle 1601. A pneumatic system connected to spindle assembly 429 through fitting 1605 opens and closes collet 1603 to release and grip the workpiece. A servomotor 1607 (FIG. 16) spins spindle 1601 at a selected speed. Linear actuator 463 moves spindle assembly 429 toward and away from the working area. Linear actuator 463 includes a servomotor (not shown) attached to motor support 465. This servomotor rotates a feed screw enclosed within elongated housing 415, on a nut attached to spindle assembly 429 and also enclosed within housing 415, to cause this movement.

The passageway through spindle 1601 is aligned both horizontally and vertically with the top surface 915 (FIG. 9) of platform 423. Linear actuator 463 is attached to frame 401, through turntable pivot 473, and to ram assembly 433 through threaded pivot 467. Linear actuator 463 pivots on these pivots as ram assembly 433 moves laterally toward and away from grinding wheel 425. This pivoting maintains the horizontal alignment of the passageway through spindle 1601 with the top surface 915 of platform 423 during this lateral movement. Turning a nut (not shown) on threaded pivot 467 adjusts the vertical alignment of the passageway through spindle 1601 with top surface 915. Such a vertical adjustment may be necessary, for example, to accommodate differently sized workpieces.

Housing 415 includes on its side a magnetically encoded strip 417. Encoder head 419 detects magnetic pulses that this magnetically encoded strip generates during movement of spindle assembly 429 and provides, in response, electrical pulses to computer system 457. Based upon these electrical pulses, computer system 457 continuously calculates and determines the position of spindle assembly 429 during the grinding process. A collapsible carrier 601 houses pneumatic hoses and electrical cable connected to spindle assembly 429. Housing 415 is supported on a frame 401 which includes holders 461 for holding workpieces.

A second spindle assembly 427 is attached to a linear actuator 469 positioned behind the working area. The construction and operation of spindle assembly 427 is essentially the same as that for spindle assembly 429. Spindle assembly 427 moves toward and away from the working area in response to linear actuator 469. The construction and operation of linear actuator 469 is essentially the same as that for linear actuator 463. Linear actuator 469 includes a servomotor (not shown) attached to motor support 471. This servomotor rotates a feed screw enclosed within elongated housing 443, on a nut attached to spindle assembly 427 and also enclosed within housing 443, to cause this movement. Housing 443 includes on its side a magnetically encoded strip 445. An encoder head 611 (FIG. 6C) detects magnetic pulses that this magnetically encoded strip generates during movement of spindle assembly 427 and provides, in response, electrical pulses to computer system 457. Based upon these electrical pulses, computer system 457 continuously calculates and determines the position of spindle assembly 427 during the grinding process.

The passageway through spindle assembly 427 also is aligned both horizontally and vertically with the top surface 915 of platform 423 and, therefore, also with the passageway through spindle assembly 429. Linear actuator 469 is attached to actuator support 477, through turntable pivot 475, and to ram assembly 433 through a threaded pivot (not shown) similar to threaded pivot 467. Linear actuator 469 pivots on these pivots as ram assembly 433 moves toward and away from grinding wheel 425 to maintain horizontal alignment of the passageway through spindle assembly 427 with the top surface 915 of platform 423 and the passageway through spindle 1601 during this movement. Turning a nut on the threaded pivot adjusts the vertical alignment of the passageway through spindle assembly 427 with top surface 915. Like for linear actuator 463, such a vertical adjustment may be necessary, for example, to accommodate differently sized workpieces.

In lieu of determining the position of spindle assemblies 429 and 427 using the magnetic sensing system discussed above, other sensing systems could be employed for this purpose. For example, an optical sensing system such as that used on ram assembly 433 or as disclosed in U.S. Pat. No. 5,480,342, the subject matter of which is incorporated herein by reference, could be used for this purpose. Also, in lieu of determining the position of ram assembly 433 using the optical sensing system discussed above, other sensing systems could be employed for this purpose. For example, a magnetic sensing system such as that used on spindle assemblies 429 and 427, or an optical sensing system such as that disclosed in U.S. Pat. No. 5,480,342, could be used for this purpose.

Figure 14:
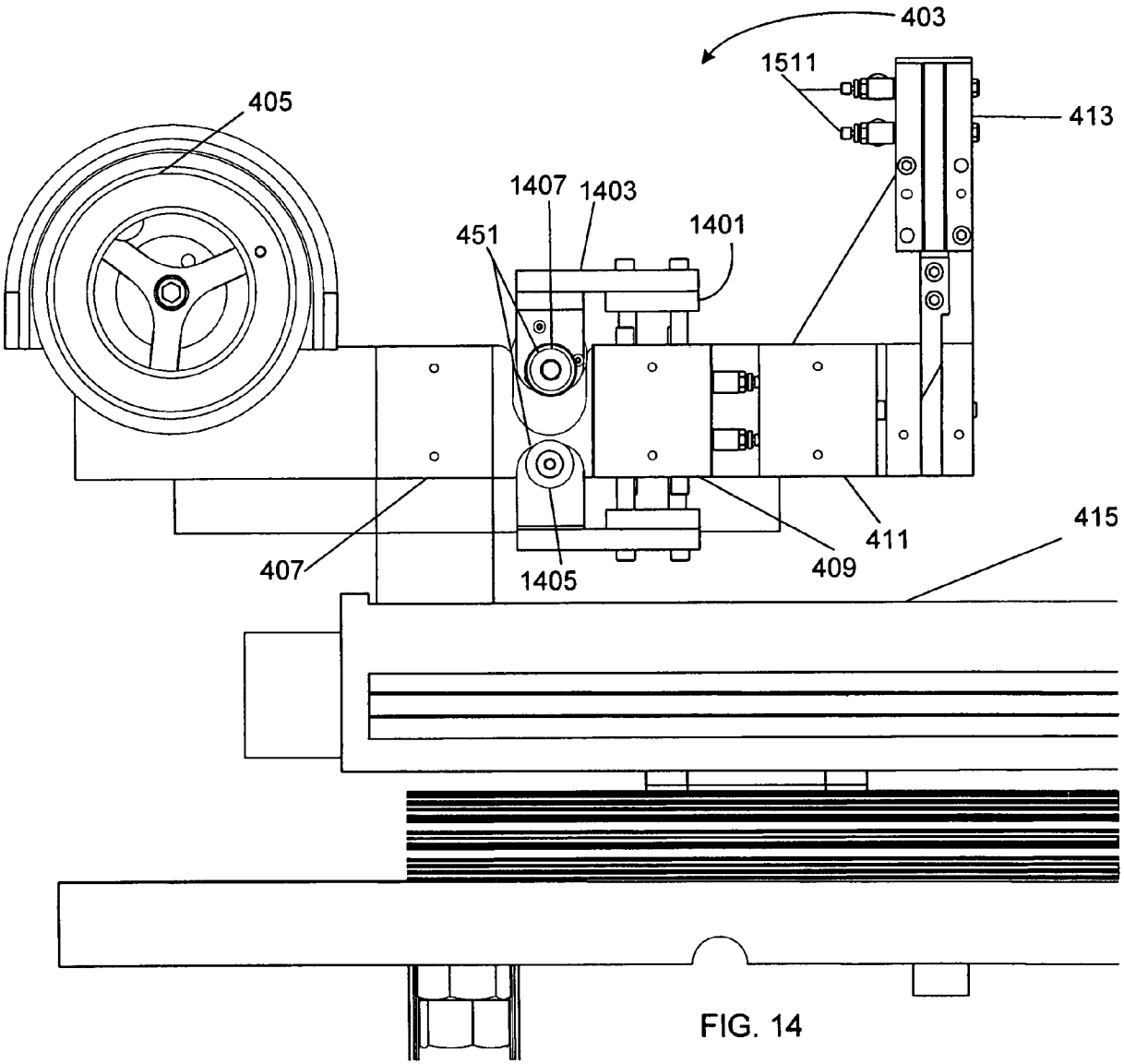
FIG. 14 is a front elevational view of the wire spool assembly of the centerless grinder of FIGS. 4-6C.
Figure 15:
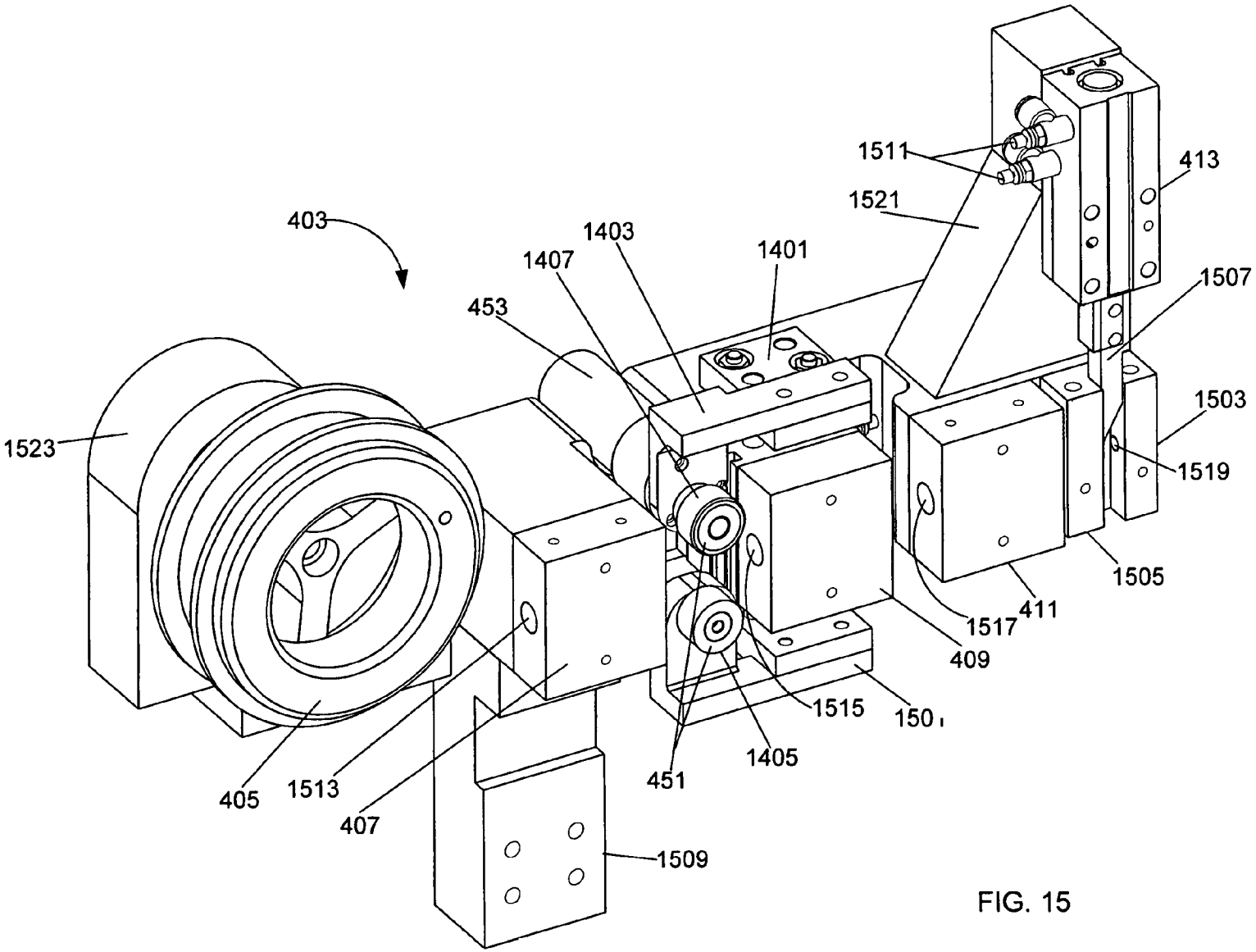
FIG. 15 is a perspective view of the wire spool assembly of the centerless grinder of FIGS. 4-6C.

Centerless grinder 400 includes a wire spool assembly 403 for automatically providing workpieces for grinding. Wire spool assembly 403, shown in greater detail in FIGS. 14 and 15, is attached to the back side of housing 415 using bracket 1509. Wire spool assembly 403 includes a spool 405 which rotates freely on spindle bearings (not shown) within spool block 1523. Wire stock, or the raw stock of another material such as plastic tubing, etc., is wrapped around spool 405. This wire stock is directed off of spool 405 from the spool's bottom through passageways 1513, 1515 and 1517 of guide blocks 407, 409 and 411, respectively. Wire stock leaving passageway 1517 is directed through a passageway (not shown) in shear block 1505 and then through a passageway 1519 in shear block 1503. Wire stock leaving passageway 1519 is directed over housing 415 into the passageway of spindle 1601 of spindle assembly 429. The passageway of spindle 1601 is aligned both horizontally and vertically with the passageways through the guide blocks and shear blocks. Each of passageways 1513, 1515, 1517, 1519 and the passageway in shear block 1505 contains a bushing having an inner diameter slightly greater than the diameter of the wire stock. Each of these bushings is removable and can be replaced with a differently sized bushing to accommodate differently sized wire stock.

Pinch rollers 451 are positioned between guide blocks 407 and 409. Pinch rollers 451 include a drive roller 1407 and an idler roller 1405. Wire stock leaving passageway 1513 is directed between drive roller 1407 and idler roller 1405, shown in the open position in FIGS. 14 and 15. When pinch rollers 451 are closed, the pinch rollers grip the wire stock and prevent the wire stock from being dispensed from reel 405. A DC drive motor 453 drives drive roller 1407, and, when pinch rollers 451 are closed, this driving pulls wire stock from reel 405 through the passageways in the guide blocks and shear blocks. In lieu of a DC drive motor for driving drive roller 1407, other motors could be used for this purpose, for example, a servomotor or a stepper motor. When drive motor 453 is inactive, drive roller 1407 is locked. Drive arm 1403 and idler arm 1501 of parallel gripper 1401 move pinch rollers 451 between the open and closed positions. A pneumatic system actuates parallel gripper 1401. Other means could be used to grip the wire stock on wire spool 405 and pull this stock from the spool. For example, a pneumatically actuated indexing gripper could be used for this purpose.

A shear blade 1507 is positioned between shear block 1505 and shear block 1503. Shear cylinder 413, attached to cylinder block 1521 and connected to the pneumatic system through fittings 1511, pneumatically actuates this shear blade. The tip of shear blade 1507 is positioned immediately adjacent the outlet of the passageway in shear block 1505. Upon transmission of a sufficient length of wire stock past this outlet, shear cylinder 413 is actuated to drive shear blade 1507 downwardly to cut the wire stock and provide the workpiece. Other means could be used for cutting the wire stock. For example, an abrasive cutting wheel could be used for this purpose. For stock made of plastics, for example, a laser could be used for this purpose. Electrical discharge machining (EDM) or a waterjet also could be used for cutting the stock.

Figure 7:
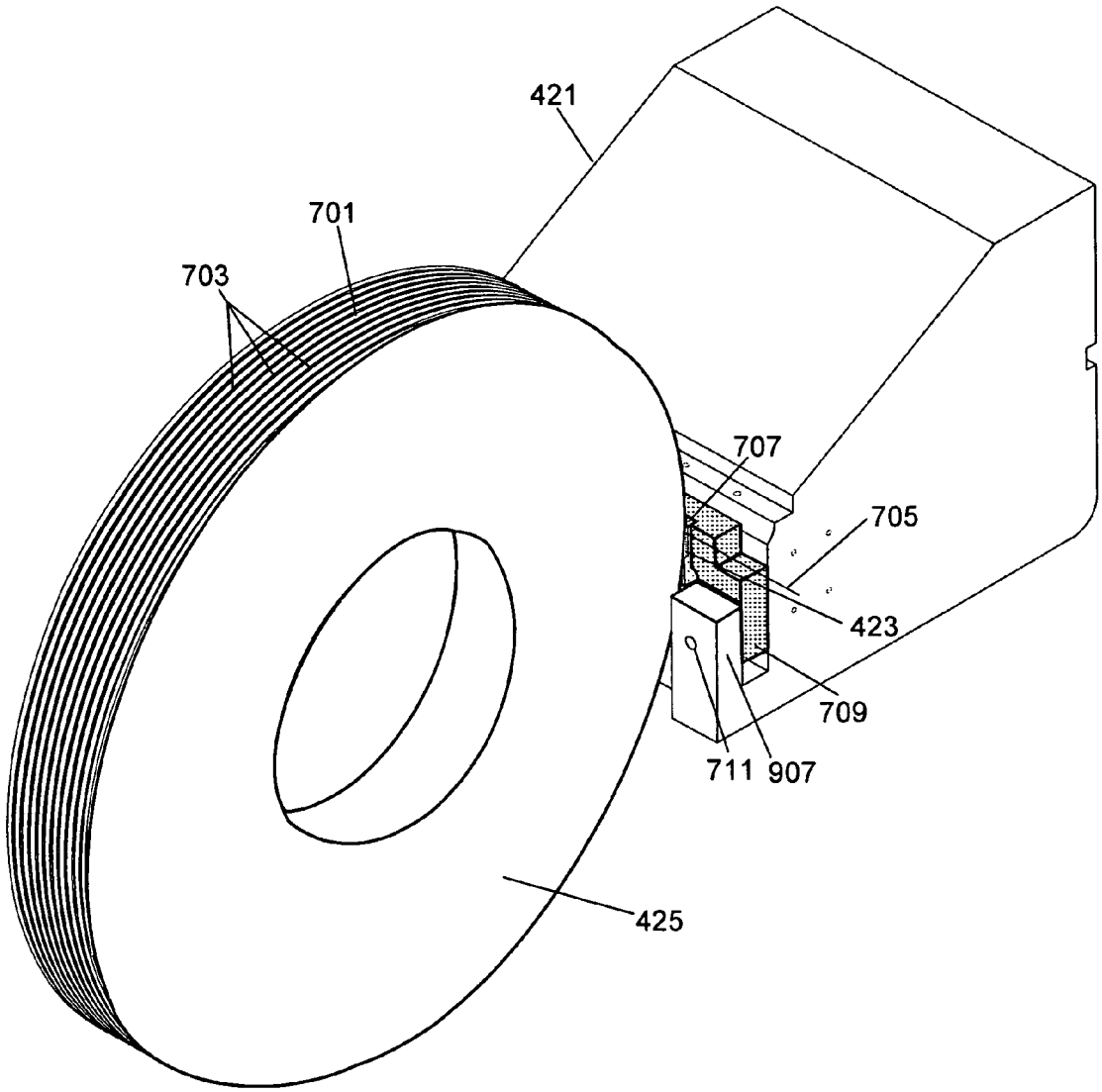
FIG. 7 is a perspective view of the grinding wheel, grinding platform and grinding platform holders of the centerless grinder of FIGS. 4-6C.
Figure 8:
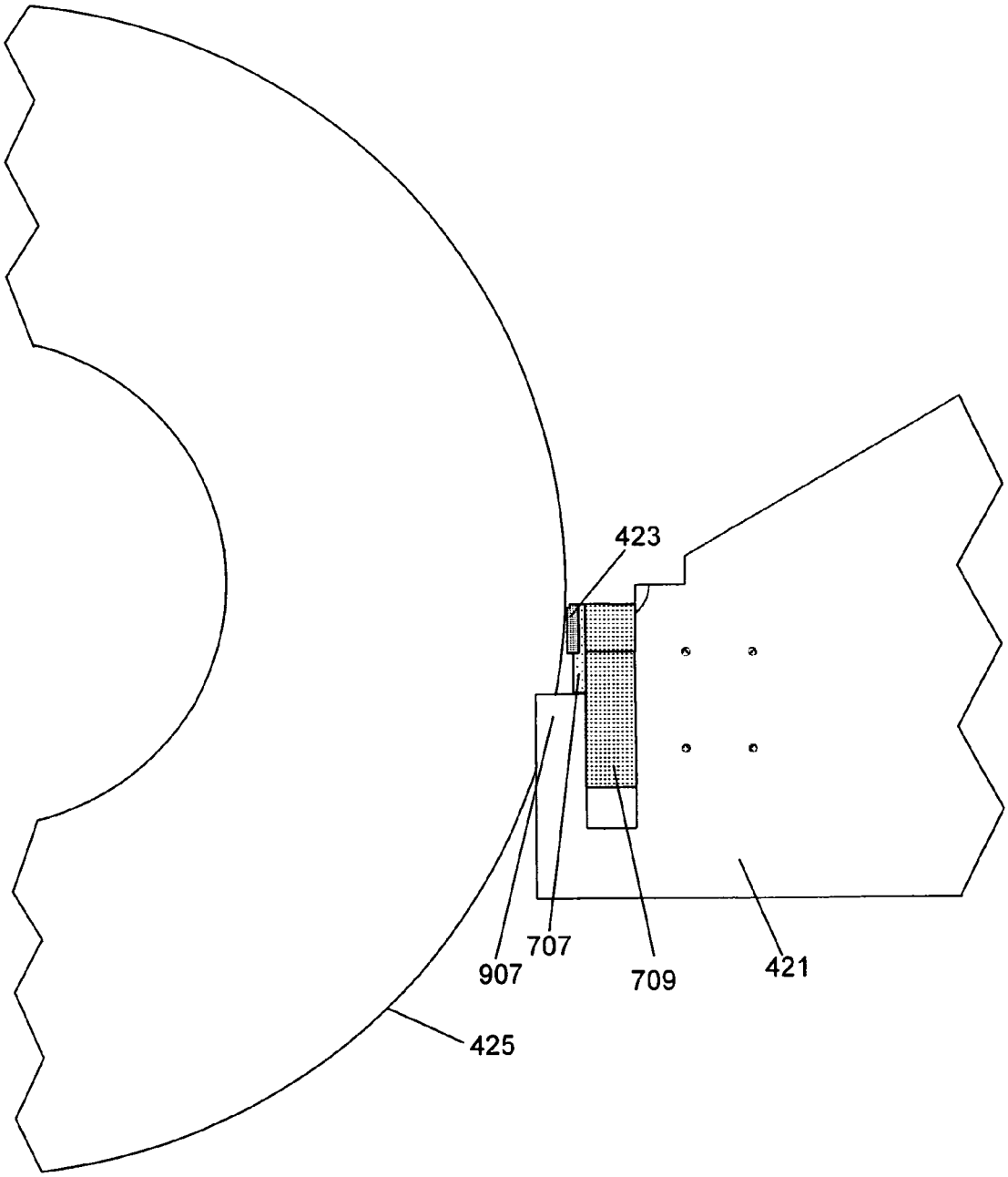
FIG. 8 is a side view of the grinding wheel, grinding platform and grinding platform holders of the centerless grinder of FIGS. 4-6C.
Figure 9:
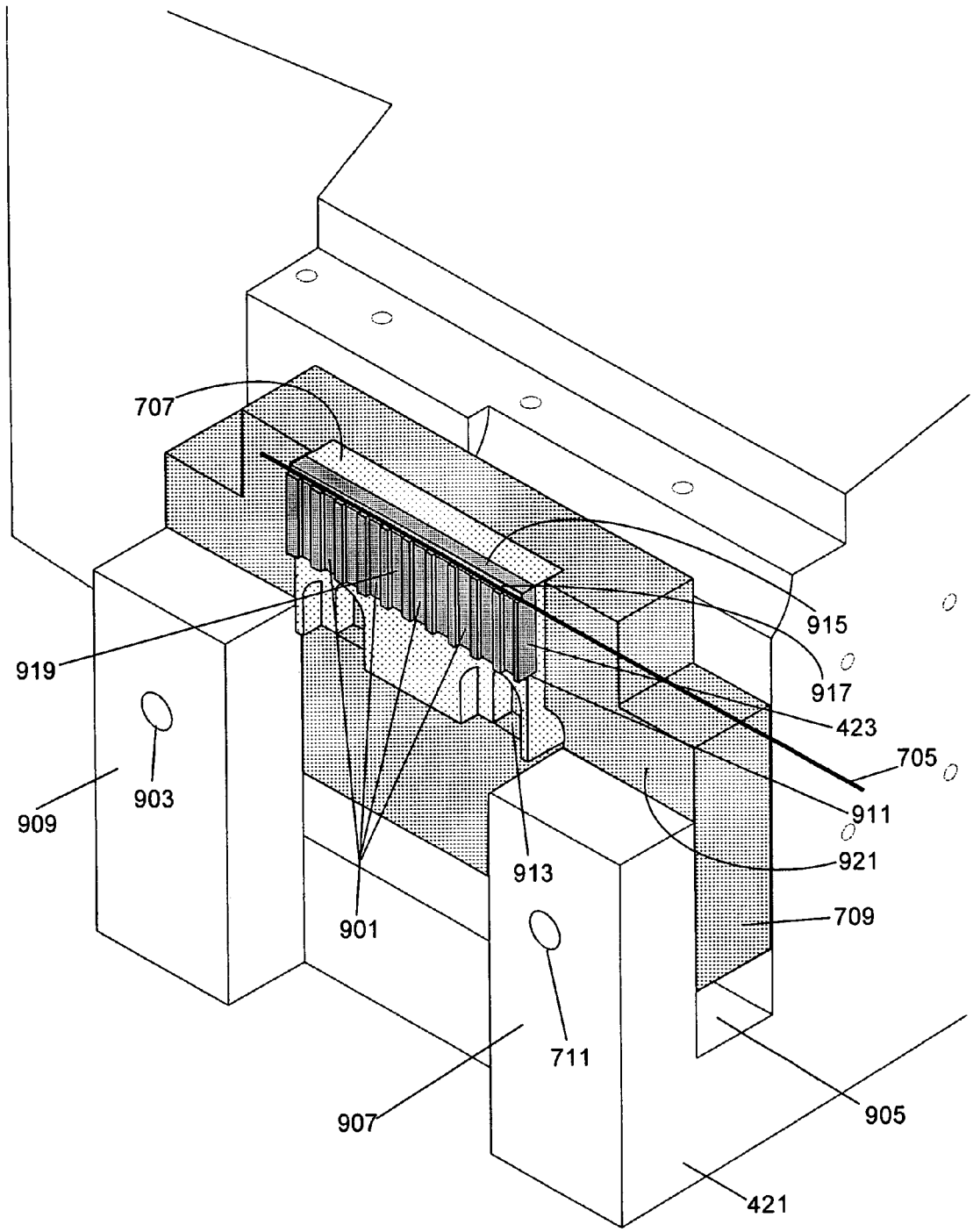
FIG. 9 is a perspective view of the grinding platform and grinding platform holders of the centerless grinder of FIGS. 4-6C.
Figure 10:
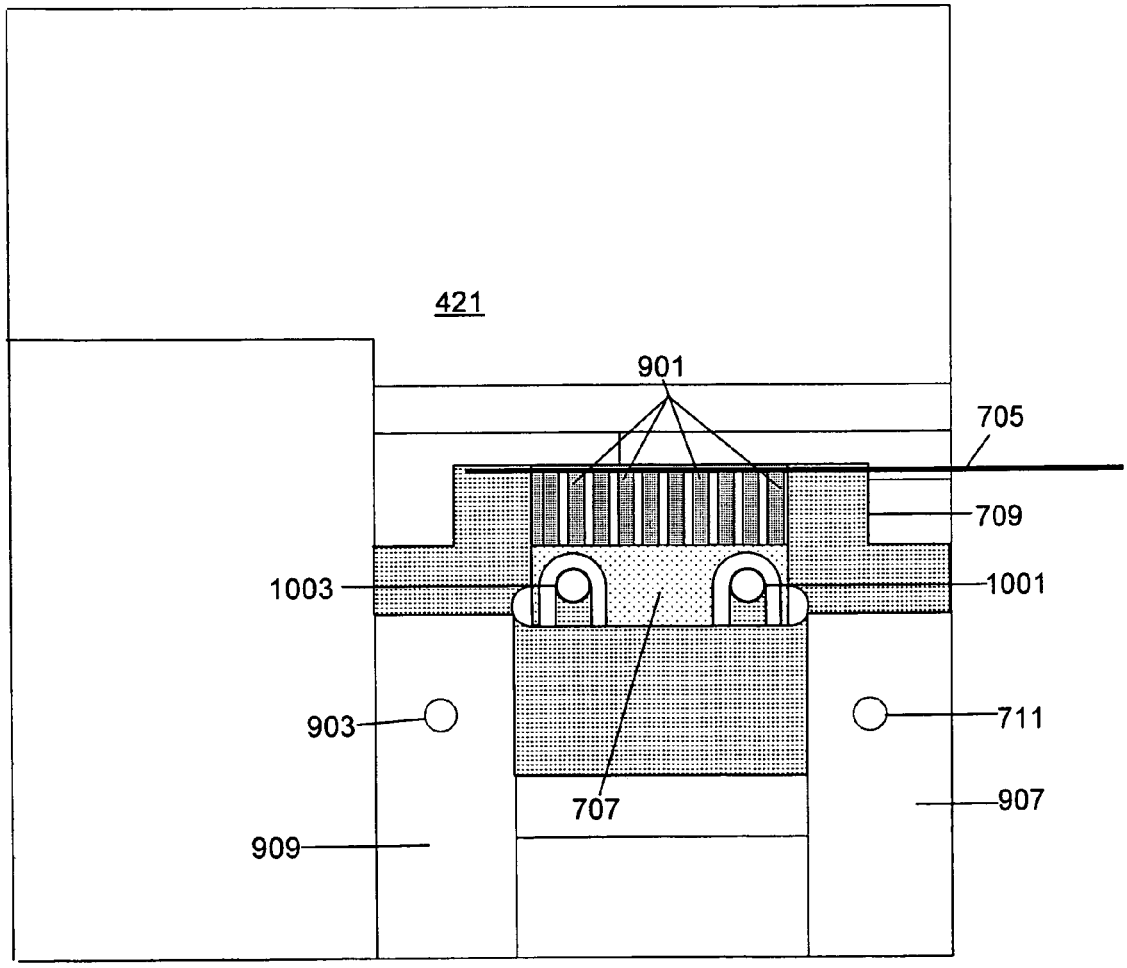
FIG. 10 is a front elevational view of the grinding platform and grinding platform holders of the centerless grinder of FIGS. 4-6C.
Figure 11:
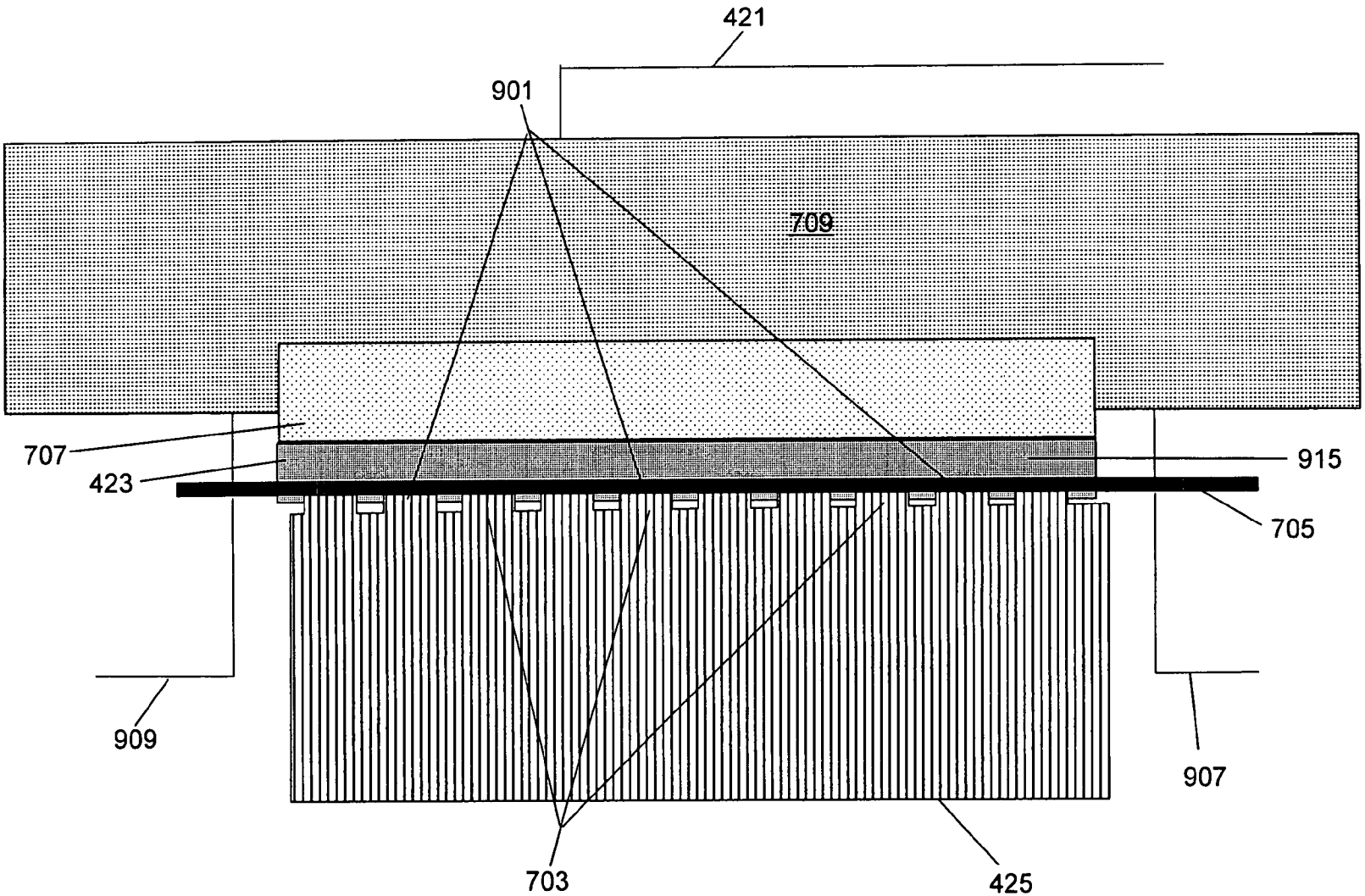
FIG. 11 is a top plan view of the grinding wheel, grinding platform and grinding platform holders of the centerless grinder of FIGS. 4-6C.

Platform 423, grinding wheel 425 and the holders for platform 423 are shown in greater detail in FIGS. 7-13. As shown in FIGS. 7 and 11, the working surface 701 of grinding wheel 425 includes a plurality of raised areas 703. These raised areas are equally spaced across the width of the working surface of the grinding wheel and extend circumferentially around the entire working surface. In the alternative, these raised areas could be irregularly spaced across the width of the working surface or extend around only a portion of the working surface. Also, in the alternative, the raised areas could extend circumferentially only within a plurality of regularly or irregularly spaced segments of the working surface.

Platform 423 preferably is manufactured from an extremely hard, strong material, such as carbide, and has the general shape of a thin, rectangular parallelepiped. In lieu of carbide, platform 423 could be manufactured from other materials, for example, heat-treated steel, tool steel, polycrystalline diamond (PCD), carbon fiber, a ceramic, Teflon™ "polytetrafluorethylene (PTFE)," Nylon™ "polyamide (PA)" and other types of plastics. Such manufacturing materials could be selected based upon the types of materials for which platform 423 is used to grind.

Platform 423 is approximately 2.5 inches wide, 1.5 inches tall and 0.25 inches thick. The platform's width exceeds by approximately 1 inch the width of working surface 701 of grinding wheel 425 (the width of which is approximately 1.5 inches). Platform 423 includes an elongated top surface 915 for supporting workpiece 705 adjacent to working surface 701. The front surface 919 of platform 423 includes a plurality of lateral grooves 901 for receiving raised areas 703 on the working surface 701 of the grinding wheel. Lateral grooves 901 are equally spaced across the length of working surface 701 and align with raised areas 703. In the alternative, if raised areas 703 are irregularly spaced across the width of working surface 701, lateral grooves 901 also would be irregularly spaced across the length of working surface 701 to align with this irregular spacing. As a result of the alignment of raised areas 703 and lateral grooves 901, when ram assembly 433 moves platform 423 into the working area adjacent grinding wheel 425, raised areas 703 pass into lateral grooves 901 to grind workpiece 705. Spindle assembly 429 or spindle assembly 427 control the rotation, and forward and backward movement, of workpiece 705 during this grinding.

Figure 12:
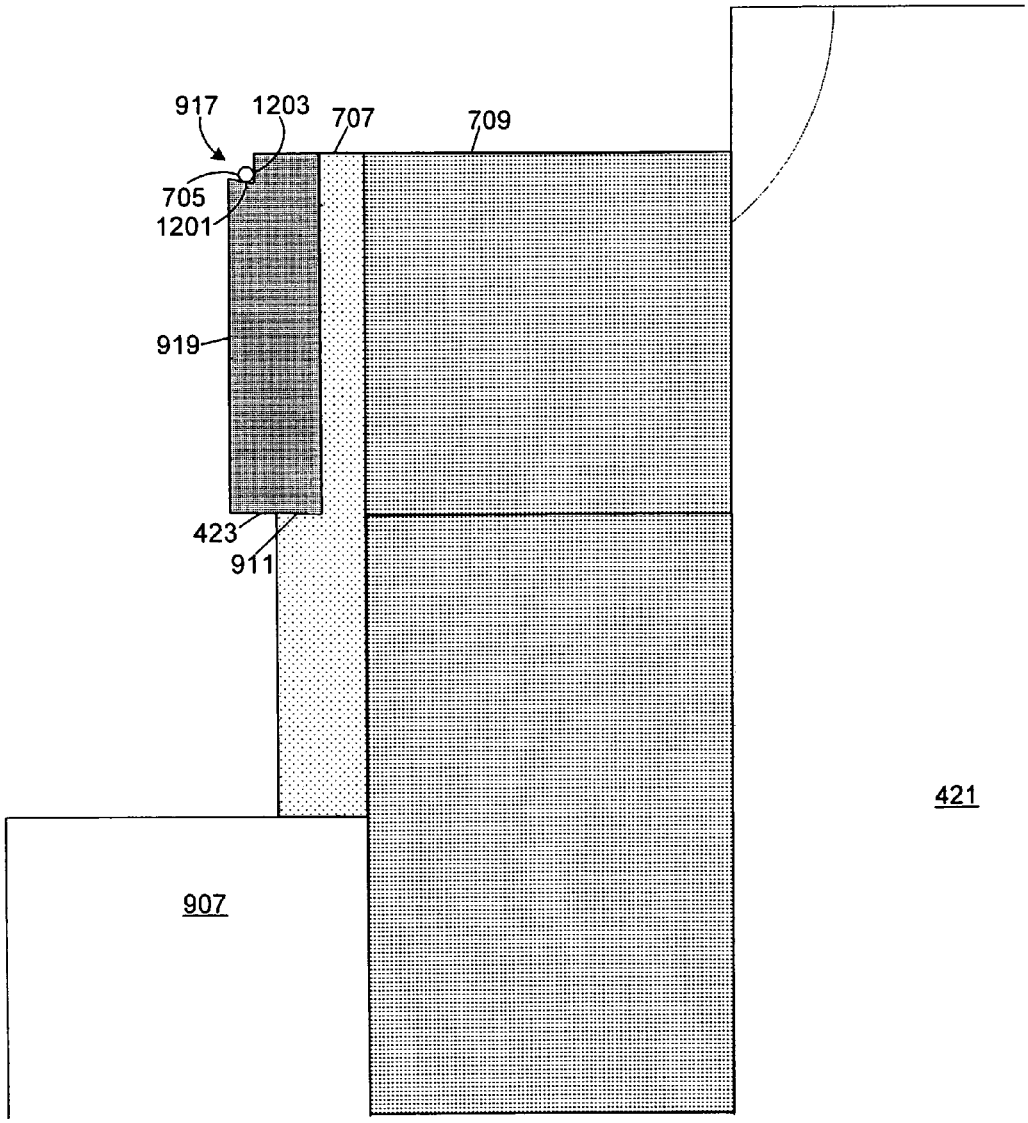
FIG. 12 is a side elevational view of the grinding platform and grinding platform holders of the centerless grinder of FIGS. 4-6C.
Figure 13:
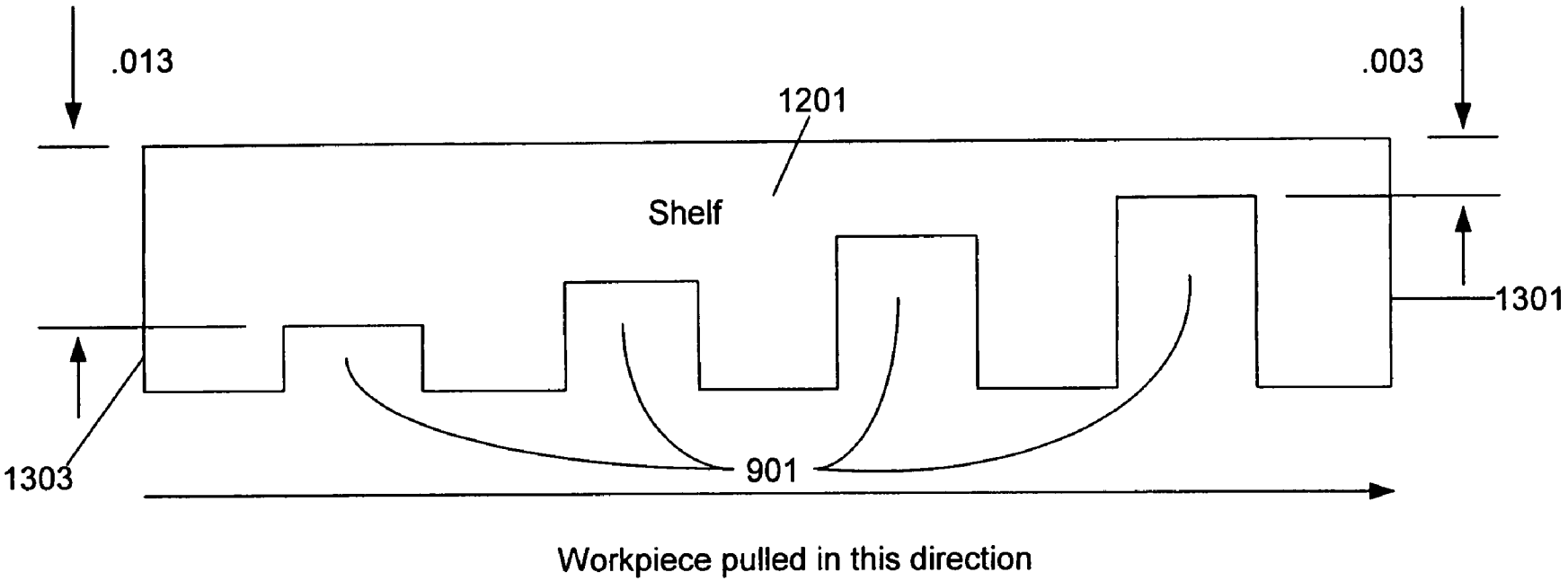
FIG. 13 is a schematic top plan view of the grinding platform of the centerless grinder of FIGS. 4-6C.

Platform 423 includes an elongated, generally L-shaped (when viewed from the side as shown in FIG. 12) groove 917 formed at the intersection of front surface 919 and top surface 915. The bottom of groove 917 forms a shelf 1201 (FIGS. 12 and 13) within which workpiece 705 is supported during the grinding process. Lateral grooves 901 extend up front face 919 into shelf 1201. As schematically shown in FIG. 13, the depth of lateral grooves 901 into front surface 919 tapers from a greater depth near front end 1301 of platform 423 (facing housing 415) to a lesser depth near back end 1303 (facing housing 443). As a result, as shown in FIG. 13, the width of shelf 1201 between the back 1203 (FIG. 12) of groove 917 and the front of lateral grooves 901 tapers from a greater width near back end 1303 to a lesser width near front end 1301. This width is approximately 0.013 inches at back end 1303 and approximately 0.003 inches at front end 1301. The width at front end 1301 can be decreased to approximately 0.001 inches, and, to accommodate larger workpieces, the width at back end 1303 can be increased to approximately 1.0 inches. The height of raised areas 703 on working surface 701 has a taper that matches the taper in the depth of lateral grooves 901 into front surface 919. The height of raised areas 703, therefore, tapers from a greater height at front end 1301 to a lesser height at back end 1303. In a typical grinding operation, spindle assembly 429 pulls workpiece 705 from back end 1303 toward front end 1301 as shown in FIG. 13. As a result, even if the position of ram assembly 433 remains constant, the extent of grinding at each point of the workpiece increases as the workpiece is being pulled from the working area on shelf 1201. The workpiece can be ground to a diameter of only approximately 0.001 inches, moreover, a far smaller diameter than is possible with a conventional centerless grinder using a regulating wheel and a work rest blade.

As shown in FIG. 12, shelf 1201 of groove 917 slopes upwardly at a slight angle (approximately 10° from the horizontal) in the direction of working surface 701. This slope urges workpiece 705 toward the back 1203 and corner of groove 917 during the grinding process and assists in retaining the workpiece within groove 917 during this process.

Platform 423 is attached to ram assembly 433 by holders 707, 709 and 421. As shown in FIGS. 7-12, platform 423 is attached to holder 707, holder 707 is attached to holder 709 and holder 709 is held within slot 905 of holder 421.

Platform 423 is positioned within notch 911 of holder 707 and is brazed to the back of this notch. Holder 707 preferably is manufactured from steel. Holder 707 is positioned within notch 913 of holder 709 and is secured to holder 709 by button-head cap screws (not shown) driven into screw holes 1001 and 1003 (FIG. 10) of holder 709. By loosening these screws, holder 707 and platform 423 can be removed from holder 709 to replace platform 423 with, for example, a differently sized platform for grinding differently sized workpieces.

Slot 905 of holder 421 is formed by arms 907 and 909 of this holder. Holder 709 can be moved within this slot to enable proper alignment of platform 423 with respect to grinding wheel 425 and the spindle assemblies. Upon determining the proper alignment, holder 709 is secured in position by screws (not shown) driven through screw holes 711 and 903 within arms 907 and 909, respectively, into the front surface 921 of holder 709. These screws wedge holder 709 within slot 905. Shims can be placed into slot 905 under holder 709 to more securely hold holder 709 within this slot.

In operation, centerless grinder 400 can be used to grind a workpiece as a single unit (for example, a medical guide wire) or into a plurality of units that are cut from the workpiece during the grinding process (for example, a plurality of precisely ground pins). If ground as a single unit, the workpiece can be ground at only one end, using only spindle assembly 429, or at both ends using both spindle assembly 429 and spindle assembly 427. In the case of the workpiece being ground as a single unit and at only one end (referred to below as "the first end"), the grinding profile for the first end, the workpiece's total length and other parameters for grinding the workpiece first are programmed into computer system 457 using touch-sensitive computer screen 447. The entire grinding process then is controlled by computer system 457.

In executing the grinding process, computer system 457 transmits electrical signals to open collet 1603 of spindle assembly 429 and move spindle assembly 429 to a position adjacent wire spool assembly 403. Drive motor 453 of wire spool assembly 403 then is activated to drive pinch rollers 451 and dispense through the passageways of guide blocks 407, 409 and 411, shear blocks 1505 and 1503, and spindle assembly 429 a length of wire stock or other raw stock from reel 405. This dispensing is controlled to extend a portion of this length of wire stock through spindle assembly 429 toward the working area adjacent grinding wheel 425. Parallel gripper 1401 then is activated to cause drive arm 1403 and idler arm 1501 to move upwardly and downwardly, respectively, to open pinch rollers 451. Collet 1603 then is closed to grip the wire stock, and spindle assembly 429 is moved toward the working area to pull a further length of wire stock from reel 405. If the length of wire stock previously dispensed by pinch rollers 451 through spindle assembly 429 is sufficient for the workpiece, however, this step can be omitted.

When the length of wire stock dispensed from reel 405 is sufficient for the workpiece, the forward motion of spindle assembly 429 is stopped, and parallel gripper 1401 again is activated to move drive arm 1403 and idler arm 1501 downwardly and upwardly, respectively, to close pinch rollers 451. Shear cylinder 413 then is activated to drive shear blade 1507 downwardly to cut the wire stock and provide the workpiece. The forward motion of spindle assembly 429 then is resumed to move the portion of the workpiece extending through spindle assembly 429 into the working area and onto groove 917 of platform 423. Further guides (not shown) may be employed in the working area to assist in directing the workpiece onto groove 917. The forward motion of spindle assembly 429 continues until a length of the workpiece equal to or exceeding the length of the grinding profile extends through the working area.

The motor for grinding wheel 425 and the servomotor 1607 for spindle assembly 429 then are activated (if not previously activated) to rotate grinding wheel 425 and spindle 1601 at selected speeds. Computer system 457 then transmits electrical signals to the servomotors for activating the screws of spindle assembly 429 and ram assembly 433 to cause spindle assembly 429 to move backwardly away from the working area and ram assembly 433 to move laterally toward working surface 701 of grinding wheel 425 to grind the first end of the workpiece in accordance with the programmed grinding profile. These electrical signals are based upon the positions of spindle assembly 429 and ram assembly 433 continuously determined by computer system 457 from the positional signals transmitted to the computer system from encoder head 419 and the corresponding encoder head of ram assembly 433.

If necessary, when grinding of the grinding profile is completed, ram assembly 433 can be further advanced toward working surface 701 to shear the length of the workpiece extending beyond the grinding profile. In the alternative, a separate shearing mechanism, for example, a shearing mechanism similar to that employed on spool assembly 403, can be used for this purpose. Ram assembly 433 then is backed away from working surface 701, and spindle assembly 429 is moved forwardly toward the working area. The collet on spindle assembly 427 is opened (if not previously opened), and spindle assembly 427 also can be moved forwardly toward the working area. This forward movement of one or both of the spindle assemblies is continued until the workpiece's first end passes through the passageway in spindle assembly 427. One or more guidance in the working area may be provided to assist in directing the workpiece's first end through the passageway in spindle assembly 427. Collet 1603 of spindle assembly 429 then is opened, and the collet of spindle assembly 427 is closed. Spindle assembly 427 then is moved backwardly away from the working area until the length of the workpiece extending from the working area toward spindle assembly 427 equals the workpiece's programmed total length. Ram assembly 433 then is advanced toward working surface 701 to shear the workpiece to this total length. Following this shearing, spindle assembly 427 continues to move backwardly until the workpiece is removed from the working area. The collet on spindle assembly 427 then is opened to remove the finished workpiece.

Since shearing of the workpiece to the programmed total length occurs at the end of the grinding process, and the grinding profile is not executed based upon the detected position of an end of the workpiece (as in some prior-art systems), a precise measurement of the length of wire stock dispensed from wire spool assembly 403 to provide the workpiece is not required. In the alternative, however, wire spool assembly 403 can be controlled by computer system 457 to shear the wire stock precisely to the programmed total length of the workpiece.

If both ends of the workpiece are to be ground, the grinding of the workpiece's end opposite the first end (referred to below as "the second end") occurs while spindle assembly 427 is moved backwardly away from the working area. In this case, the programming of computer system 457 includes programming the grinding profile for the workpiece's second end. Again, the entire grinding process is controlled by computer system 457.

The steps for grinding the profile on the workpiece's second end are similar to those for grinding the profile on the workpiece's first end. The servomotor for spindle assembly 427 is activated (if not previously activated), in response to electrical signals from computer system 457, to rotate the spindle of this assembly at a selected speed. Computer system 457 then transmits electrical signals to the servomotors activating the screws of spindle assembly 427 and ram assembly 433 to cause spindle assembly 427 to move backwardly away from the working area and ram assembly 433 to move laterally toward working surface 701 of grinding wheel 425 to grind the second end in accordance with the programmed grinding profile. These electrical signals are based upon the positions of spindle assembly 427 and ram assembly 433 continuously determined by computer system 457 from the positional signals transmitted to the computer system from encoder head 611 and the corresponding encoder head of ram assembly 433.

If necessary, upon completion of the grinding of the second profile, ram assembly 433 again is advanced toward working surface 701 to shear the length of the workpiece extending beyond the ground profile for the second end. Following this shearing, spindle assembly 427 continues to move backwardly until the workpiece is removed from the working area. The collet on spindle assembly 427 then is opened to remove the finished workpiece.

If the workpiece is to be ground into a plurality of units that are cut from the workpiece during the grinding process, the programming of computer system 457 includes programming the grinding profile for each unit, each unit's total length and other parameters for grinding in this mode. Again, the entire grinding process is controlled by computer system 457.

The steps for grinding the workpiece in this mode are similar to those for grinding the workpiece as a single unit at only one end. The grinding of each unit occurs at the tip of the workpiece extending through spindle assembly 429. After the workpiece is secured within spindle assembly 429, spindle assembly 429 is moved forwardly toward the working area until a length of the workpiece equal to or exceeding the length of the first unit extends through the working area. Spindle assembly 429 then is moved backwardly away from the working area, and ram assembly 433 is moved laterally toward working surface 701 to grind the first unit in accordance with the programmed grinding profile for this unit. If necessary, upon completion of the grinding of the profile for the first unit, ram assembly 433 is advanced toward working surface 701 to shear the length of the workpiece extending beyond this profile. Ram assembly 433 then is backed away from working surface 701, and spindle assembly 429 is moved forwardly toward the working area for a distance corresponding to the programmed length of the first unit. Ram assembly 433 then is again moved toward working surface 701 to shear the workpiece and provide the first unit. The second and subsequent units are ground from the workpiece in a similar manner.

If necessary, the workpiece periodically can be extended further through spindle assembly 429 to provide additional stock from the workpiece for grinding additional units. To accomplish such an extension, spindle assembly 429 is moved forwardly to pass the workpiece's first end through spindle assembly 427, collet 1603 of spindle assembly 429 is opened, the collet of spindle assembly 427 is closed and one or both of spindle assembly 429 and spindle assembly 427 is moved backwardly by its respective linear actuator away from the working area to extend an additional length of the workpiece through spindle assembly 429. Collet 1603 then is closed and one or both of spindle assembly 429 and spindle assembly 427 is moved further backwardly by its respective linear actuator away from the working area to remove the workpiece from spindle assembly 427. The grinding process then is resumed using the additional length of the workpiece extended through spindle assembly 429.

In lieu of using spindle assembly 427 to grip the workpiece while one or both of spindle assembly 429 (with its collet open) and spindle assembly 427 (with its collet closed) is moved away from the working area to extend additional stock through spindle assembly 429, a gripper in the working area could be used to grip the workpiece's first end while spindle assembly 429 (with its collet open) is moved backwardly away from the working area. In lieu of a gripper, rotation of grinding wheel 425 could be stopped, and the workpiece gripped between grinding wheel 425 and platform 423 while spindle assembly 429 moves backwardly with its collet open.

Numerous variations on the embodiments discussed above could be employed. For example, rather than moving spindle assemblies 429 and 427 backwardly away from the working area to pull the workpiece through the working area for grinding the first and second ends, respectively, these assemblies could be moved forwardly toward the working area to push the workpiece through the working area for grinding these ends. For larger workpieces, raised areas 703 on the working surface 701 of grinding wheel 425, and grooves 901 on platform 423, could be omitted. Stepper motors could be used for moving the spindle assemblies, and ram assembly 433, rather than servomotors. In lieu of servomotors or stepper motors, spindle assemblies 429 and 427, and ram assembly 433, could be magnetized and moved through the application of electromagnetic force to supporting tracks. Also, the width of shelf 1201 of platform 423 could be greatest at the center and decrease from the center in the direction of both the front end 1301 and the back end 1303 of platform 423. The shelf's taper, therefore, would be funnel-shaped from the center of the platform in the direction of both front end 1301 and back end 1303, rather than funnel-shaped in only one direction from back end 1303 to front end 1301. The height of raised areas 703 on working surface 701 of grinding wheel 425 would have a corresponding taper matching the taper of shelf 1201. Such a dual-funnel taper for both shelf 1201 and raised areas 703 may be advantageous for pulling a workpiece for grinding from the center of the grinding wheel through the working area using either spindle assembly 429 or spindle assembly 427. Also, if only a single funnel-shaped taper is used, the direction of the taper could be reversed, that is, the width of shelf 1201 between the back 1203 of groove 917 and the front of lateral grooves 901 could taper from a lesser width near back end 1303 to a greater width near front end 1301. Such a taper may be advantageous when the workpiece is ground principally by pulling the workpiece through the working area using spindle assembly 427. In addition, the shelf of platform 423 could have no taper.

After shear cylinder 413 is activated to drive shear blade 1507 downwardly to cut the wire stock and provide the workpiece, the length of the workpiece passing through spindle assembly 429 could be extended before beginning the grinding process. The steps for providing such an extension could be the same as those discussed above for further extending the workpiece through spindle assembly 429 when the workpiece is to be ground into a plurality of units that are cut from the workpiece.

Figure 2:
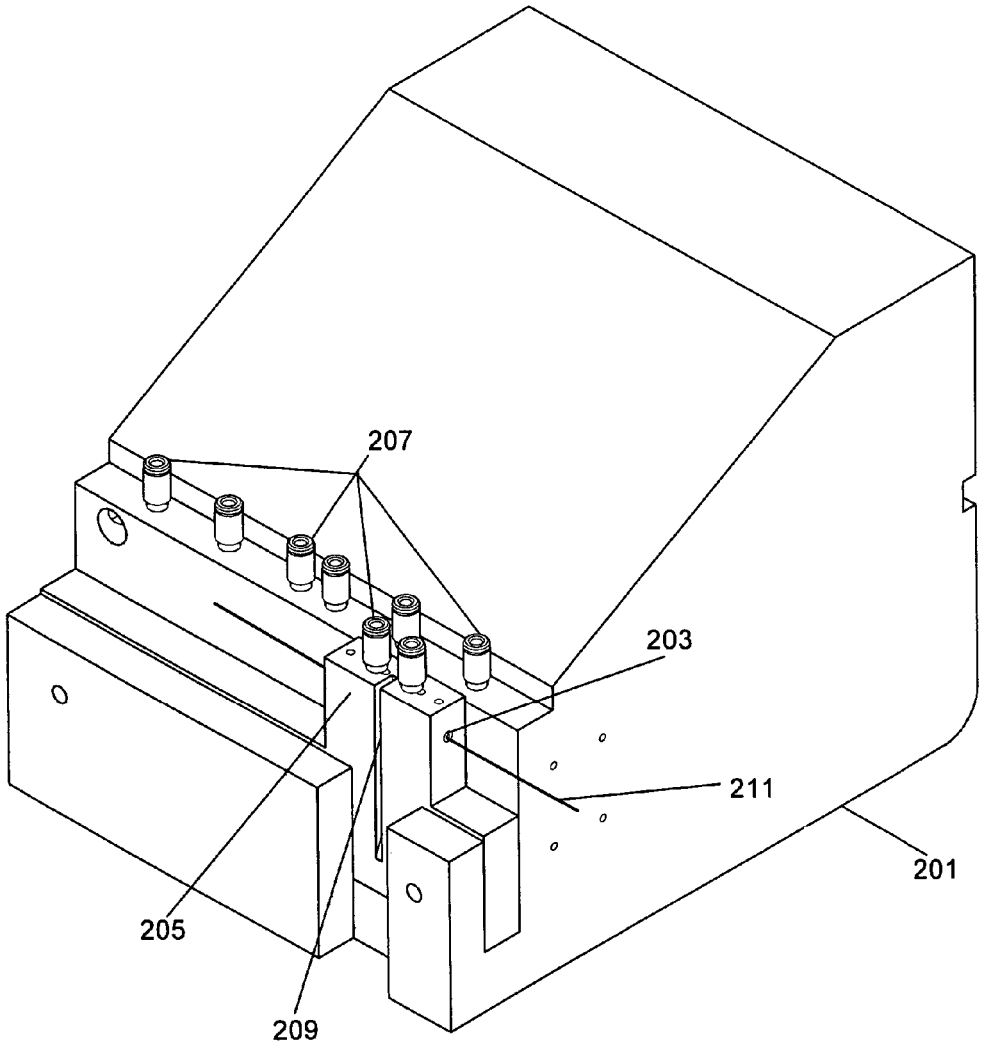
FIG. 2 (Prior Art)
FIG. 2 is a perspective view of a bushing blade holder, elongated bushing and bushing blade of a prior-art centerless grinder.
Figure 3:
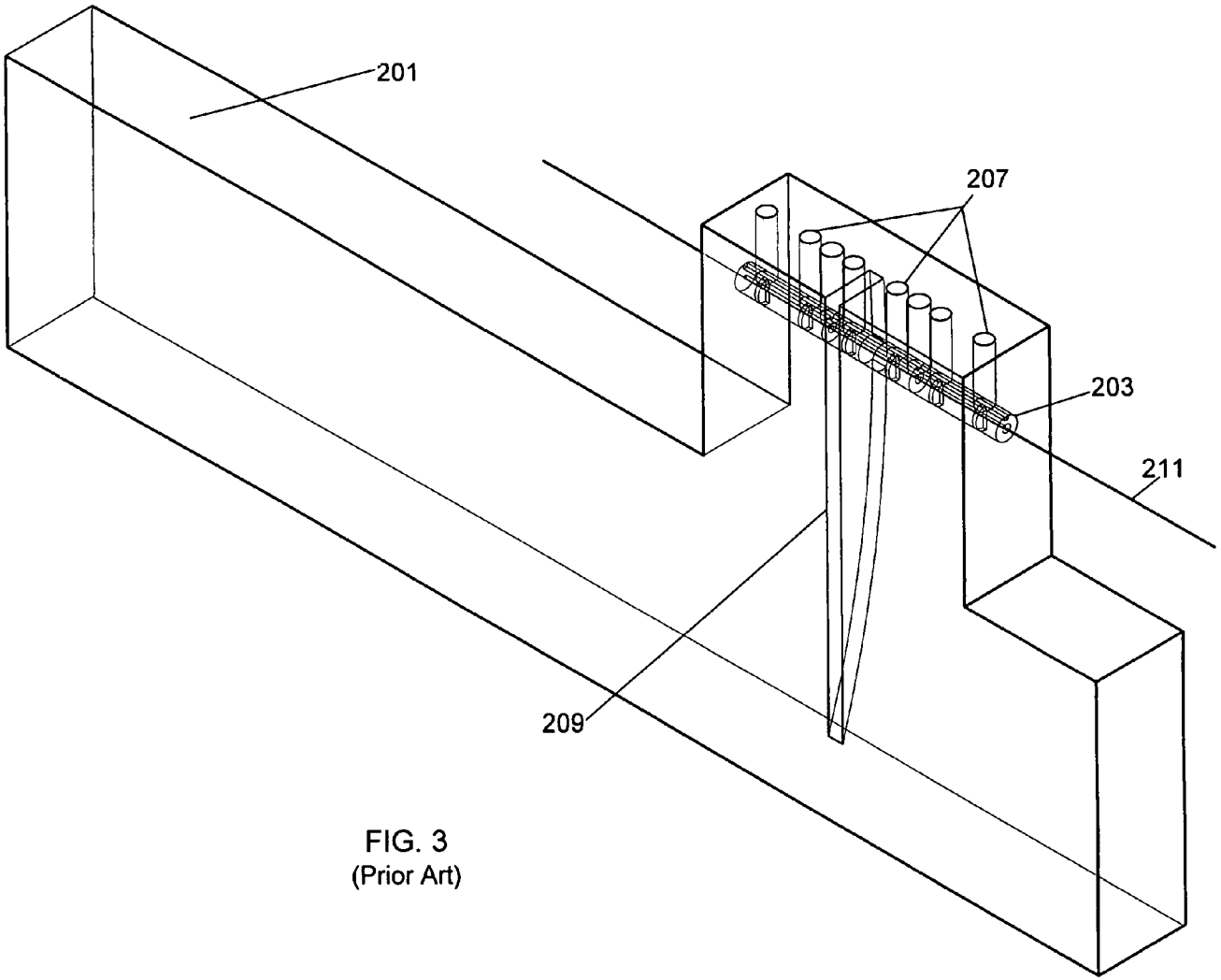
FIG. 3 (Prior Art)
FIG. 3 is a perspective view of the bushing blade holder and elongated bushing of FIG. 2.
Figure 4:
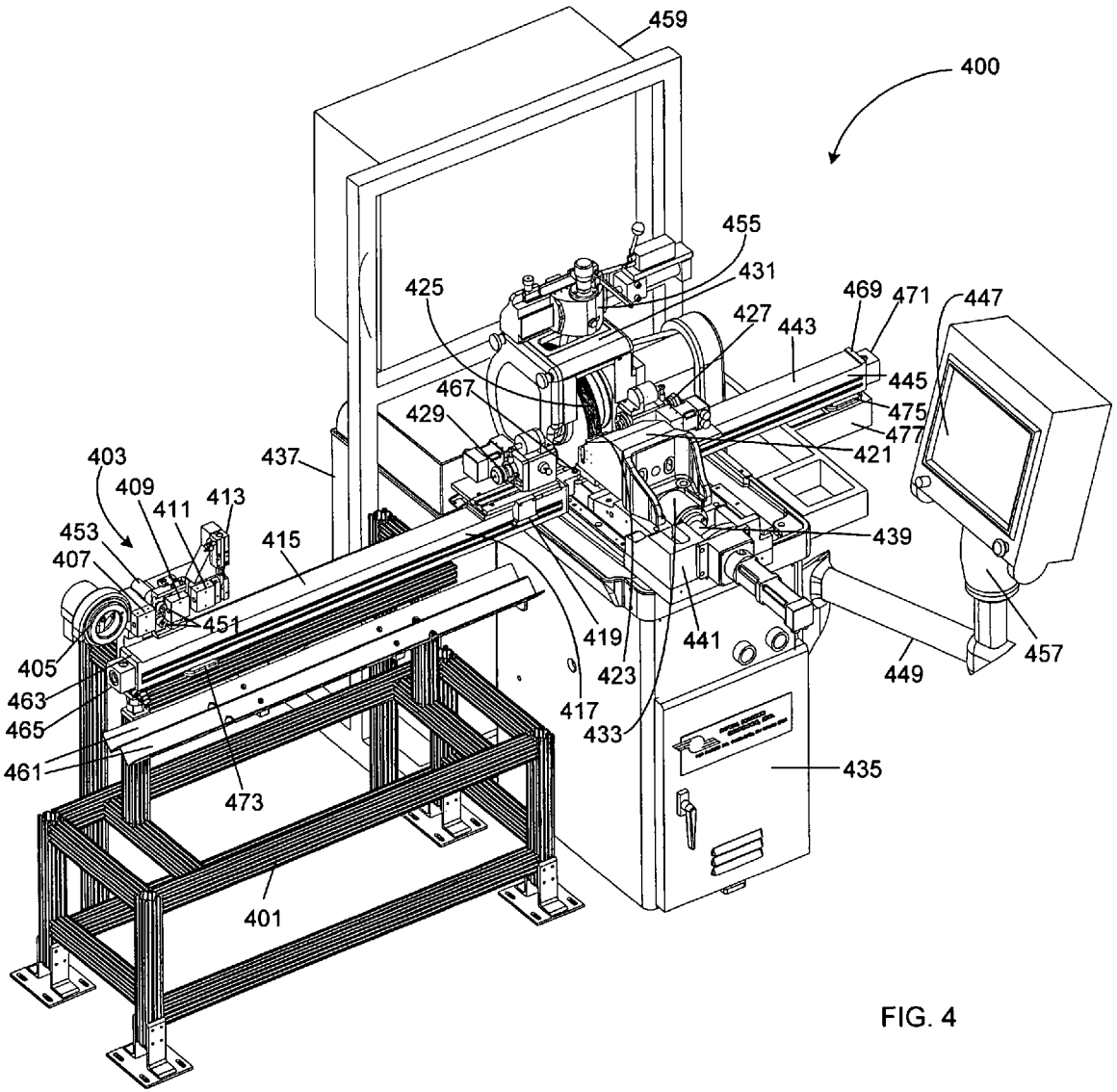
FIG. 4 is a perspective view of a centerless grinder in accordance with the present invention.
Figure 5:
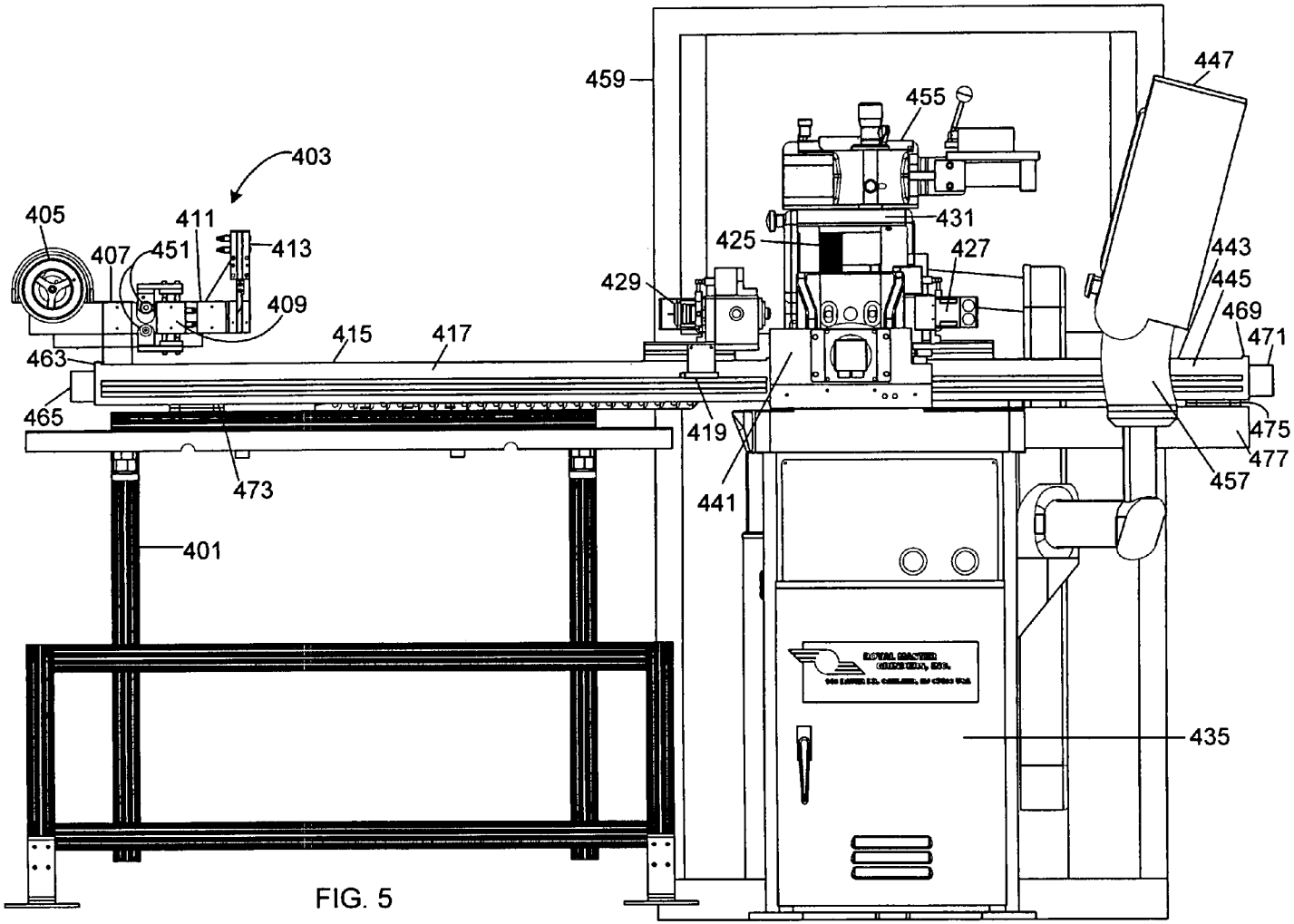
FIG. 5 is a front elevational view of the centerless grinder of FIG. 4.
Figure 6A:
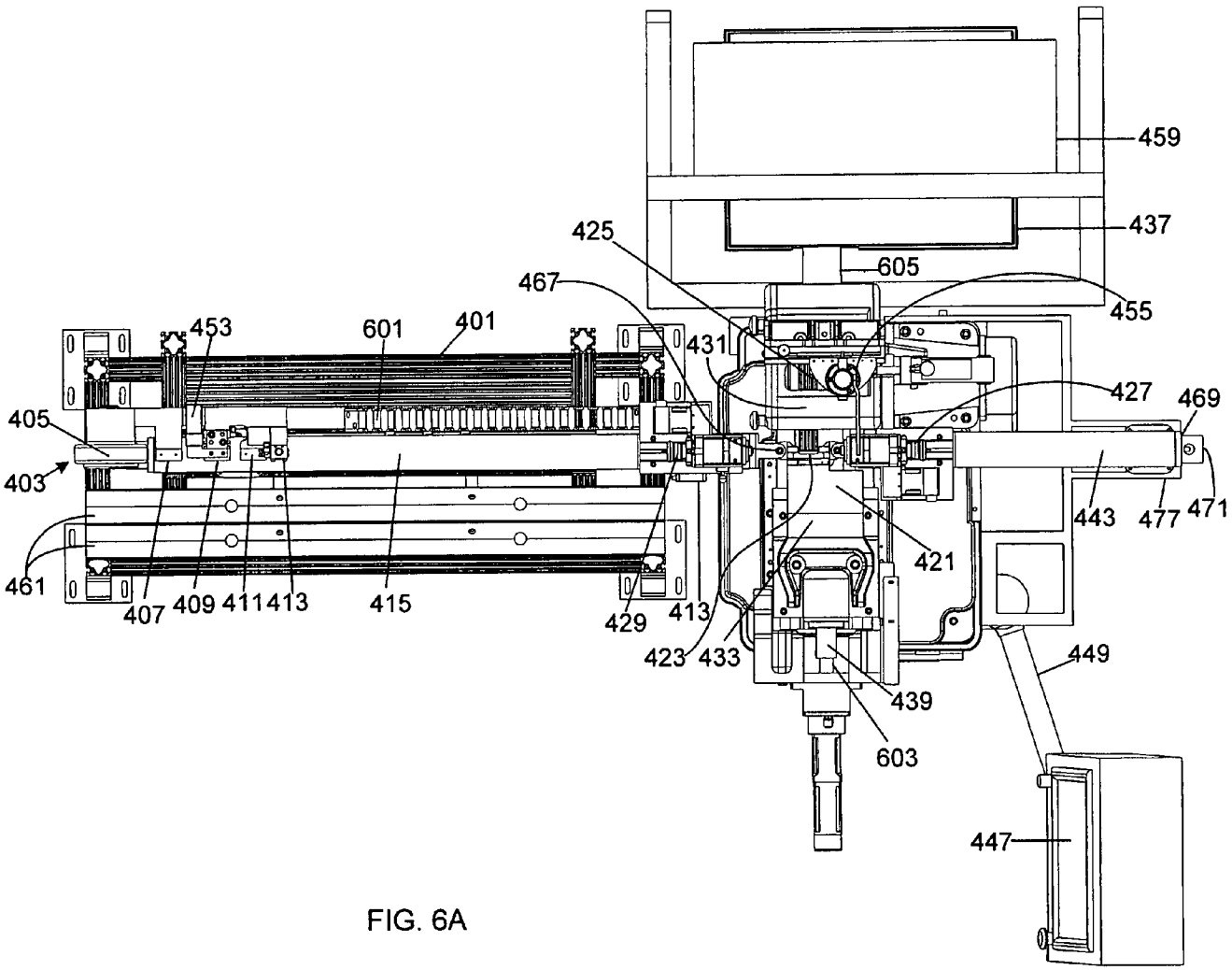
FIG. 6A is a top plan view of the centerless grinder of FIG. 4.
Figure 6B:
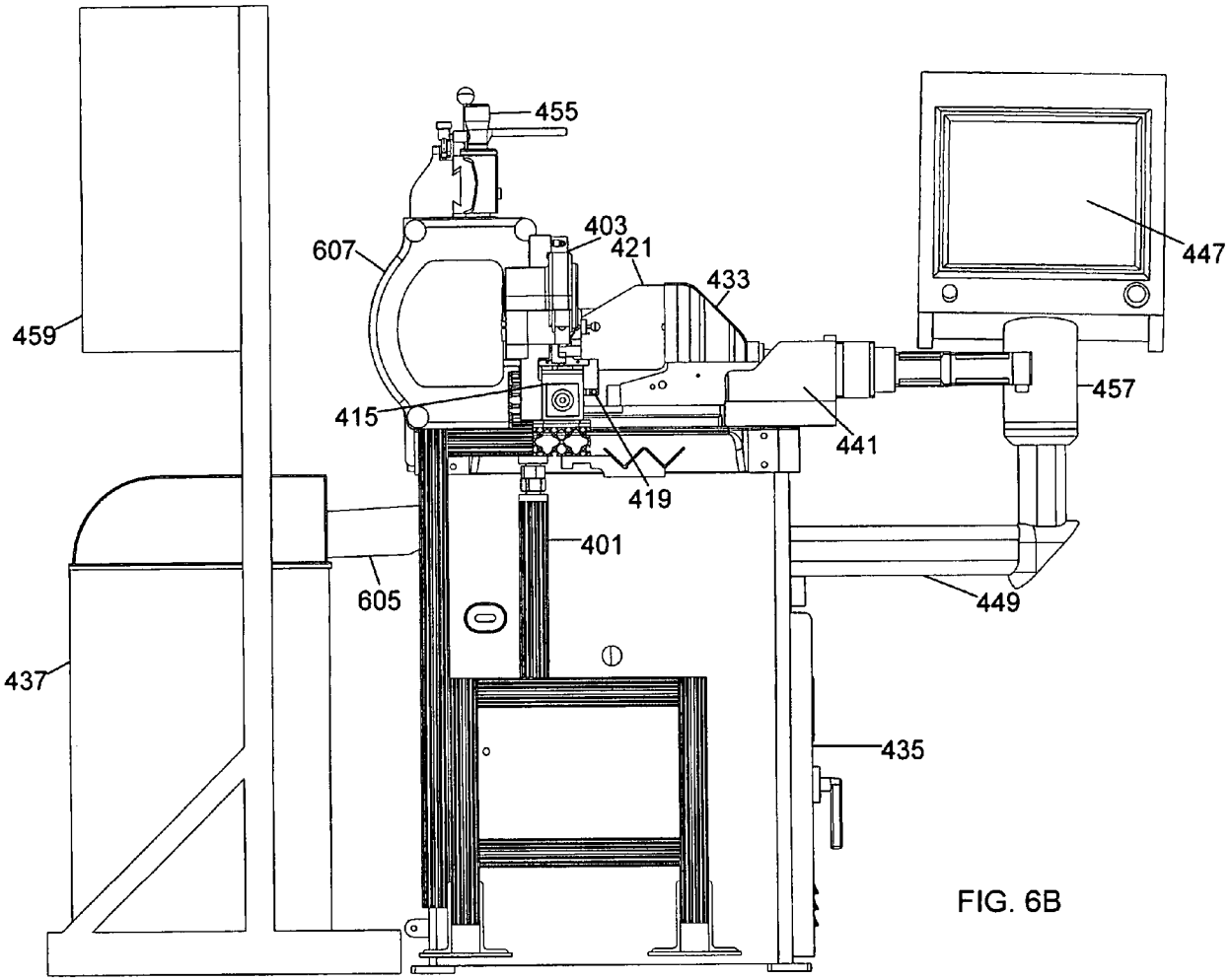
FIG. 6B is a right side elevational view of the centerless grinder of FIG. 4.
Figure 6C:
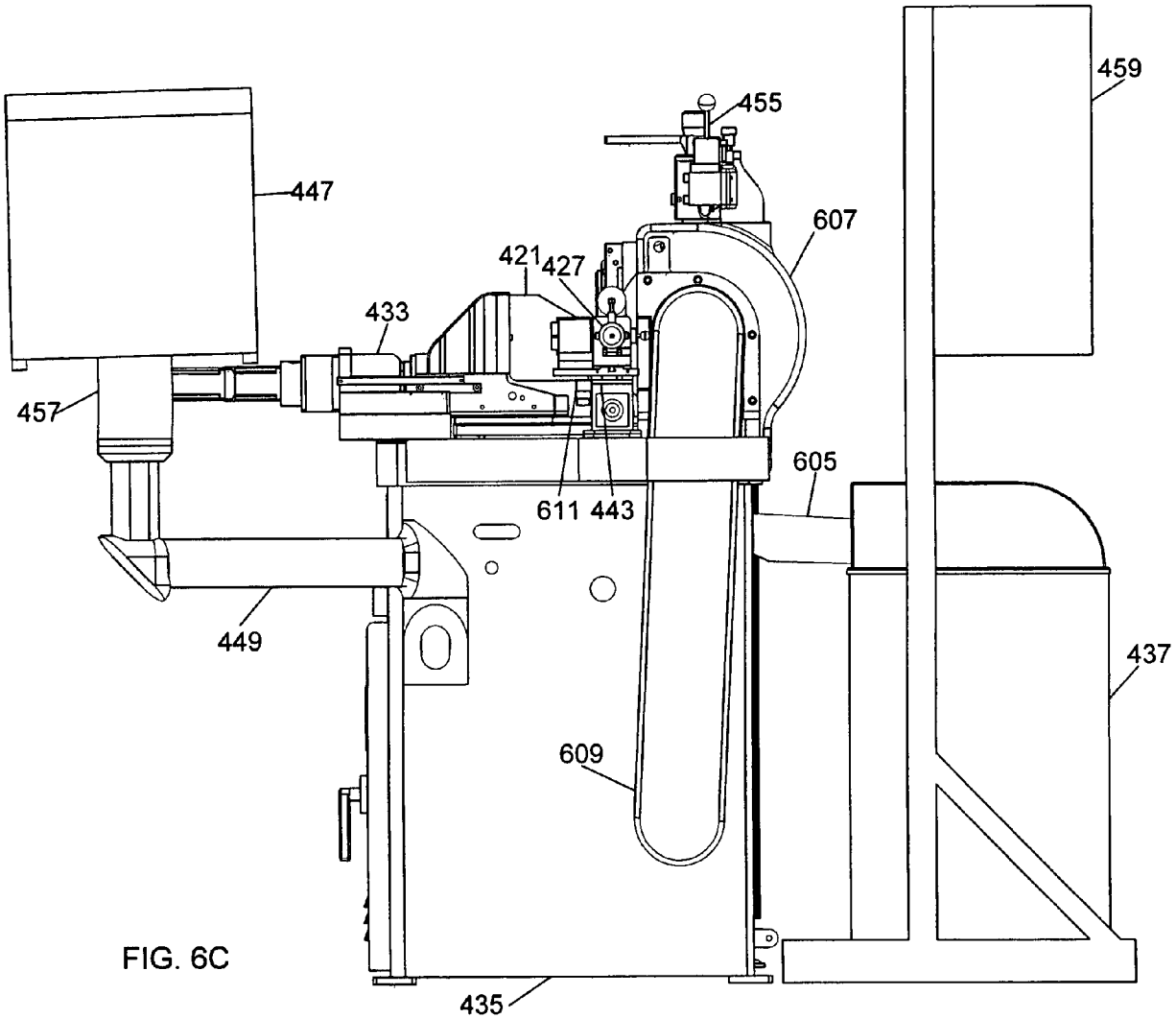
FIG. 6C is a left side elevational view of the centerless grinder of FIG. 4.

Wire spool assembly 403 could be used on a variety of centerless grinders in addition to centerless grinder 400. For example, wire spool assembly 403 could be used on a conventional centerless grinder employing a regulating wheel and a work rest blade for grinding, such as those depicted in FIG. 1, or on a centerless grinder employing a bushing blade and bushing blade holder, such as those depicted in FIGS. 2 and 3. In the case of employing wire spool assembly 403 on a conventional centerless grinder employing a regulating wheel and a work rest blade, the workpiece could be advanced from wire spool assembly 403 into the working area, where the workpiece's forward movement then would be controlled by the regulating wheel, and removed from the working area, using one or more sets of pinch rollers, such as pinch rollers 451, or using indexing grippers, positioned in front of or behind the working area. The use of wire spool assembly 403 on a centerless grinder employing a bushing blade and bushing blade holder for grinding would be substantially the same as discussed above for centerless grinder 400.

Spindle assembly 427 and linear actuator 469, positioned behind the working area, also could be used on a variety of centerless grinders in addition to centerless grinder 400. For example, spindle assembly 427 and linear actuator 469 could be used on centerless grinders employing a bushing blade and bushing blade holder such as those depicted in FIGS. 2 and 3. The use of spindle assembly 427 and linear actuator 469 on a centerless grinder employing a bushing blade and bushing blade holder for grinding also would be substantially the same as discussed above for centerless grinder 400.

Centerless grinder 400 provides numerous advantages over centerless grinders in the prior art. For example, platform 423, in combination with grinding wheel 425, enables the grinding of severe or unusual grinding profiles on workpieces that are difficult to grind, such as those made of nickel titanium, using a grinding wheel of conventional size and operating at a conventional speed. In the past, an elongated bushing assembly, such as that illustrated in FIGS. 2 and 3, and an extremely thin grinding wheel operating at slow speeds, were required for such grinding. Platform 423, in combination with grinding wheel 425, also can be used to grind conventional grinding profiles, such as those on medical guide wires, more accurately and at speeds equal to or greater than those of a conventional centerless grinder employing a work rest blade and a regulating wheel. Also, because platform 423 does not require grinding to the profile of a particular workpiece before the grinding process begins, platform 423 can be manufactured from an extremely hard material such as carbide. The life of platform 423, therefore, can far exceed that of a conventional work rest blade. In addition, with platform 423, ram assembly 433 can be moved extremely close to working surface 701 of grinding wheel 425 to grind a workpiece to an extremely thin diameter (for example, approximately 0.001 inches), or to shear the workpiece, and also can be backed away a substantial distance from the grinding wheel without any likelihood of the workpiece slipping off of the platform.

Wire spool assembly 403 and spindle assembly 427 enable complete automation of the grinding process. In the past, workpieces for a centerless grinder had to be cut prior to being fed into the working area. Wire spool assembly 403 automatically provides the workpieces to this area without manual interaction. Spindle assembly 427 automatically removes the workpieces from the working area and enables workpieces to be ground at both ends without manual interaction.

Although this invention has been described with reference to particular embodiments, these embodiments are merely illustrative of the principles and applications of the invention. Numerous modifications may be made to the illustrated embodiments, and other arrangements may be devised without departing from the spirit and scope of the invention as defined by the appended claims.

The invention claimed is:

1. A method of grinding an elongated workpiece using a centerless grinder, the centerless grinder comprising a grinding wheel having a working surface with a plurality of raised areas extending circumferentially around at least a portion of the working surface, a support for holding the workpiece and moving the workpiece laterally toward the grinding wheel into a working area adjacent the grinding wheel for grinding the workpiece, the support having a plurality of lateral grooves for receiving the raised areas, a spindle and collet positioned in front of the working area for rotating the workpiece and moving the workpiece one or both of forwardly and backwardly through the working area, a spool for holding wire stock and a guide, said method comprising:

moving the spindle and collet backwardly away from the working area;

dispensing a length of the wire stock from the spool into the guide and from the guide through the spindle and collet;

closing the collet to grip the wire stock;

cutting the wire stock to provide the workpiece;

moving the support toward the working area, while rotating the spindle and collet; and receiving the raised areas on the working surface in the plurality of lateral grooves to grind the workpiece.

2. A method as in claim 1, further comprising moving the spindle and collet forwardly toward the working area before cutting the wire stock to dispense a further length of the wire stock from the spool for the workpiece.

3. A method as in claim 1, wherein the centerless grinder further comprises pinch rollers for pulling the wire stock from the spool, and wherein the dispensing comprises rotating the pinch rollers to dispense the length of wire stock.

4. A method as in claim 1, further comprising opening the pinch rollers and moving the spindle and collet forwardly to dispense a further length of the wire stock for the workpiece before cutting the wire stock.

5. A method as in claim 4, further comprising closing the pinch rollers before cutting the wire stock to provide the workpiece.

* * * * *

UNITED STATES PATENT AND TRADEMARK OFFICE

CERTIFICATE OF CORRECTION

PATENT NO. : 7,367,868 B2
APPLICATION NO. : 11/586143
DATED : May 6, 2008
INVENTOR(S) : John R. Memmelaar, Kevin Jobes and Todd R. Morris It is certified that error appears in the above-identified patent and that said Letters Patent is hereby corrected as shown below:

Column 16, line 50, claim 4 "claim 1," should read -- claim 3 --.

Signed and Sealed this

Eighth Day of December, 2009

David J. Kappos

David J. Kappos
*Director of the United States Patent and Trademark Office*